US008157933B2

(12) United States Patent
Yokoi et al.

(10) Patent No.: US 8,157,933 B2
(45) Date of Patent: Apr. 17, 2012

(54) HIGH-STRENGTH HOT ROLLED STEEL SHEET BEING FREE FROM PEELING AND EXCELLENT IN SURFACE PROPERTIES AND BURRING PROPERTIES, AND METHOD FOR MANUFACTURING THE SAME

(75) Inventors: Tatsuo Yokoi, Tokyo (JP); Kazuya Ootsuka, Tokyo (JP); Yukiko Yamaguchi, Tokyo (JP); Tetsuya Yamada, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 166 days.

(21) Appl. No.: 12/532,782

(22) PCT Filed: Mar. 27, 2008

(86) PCT No.: PCT/JP2008/055913

§ 371 (c)(1),
(2), (4) Date: Sep. 23, 2009

(87) PCT Pub. No.: WO2008/123366

PCT Pub. Date: Oct. 16, 2008

(65) Prior Publication Data

US 2010/0108201 A1 May 6, 2010

(30) Foreign Application Priority Data

Mar. 27, 2007 (JP) ..... 2007-082567

(51) Int. Cl.

| | |
|---|---|
| ***C21D 11/00*** | (2006.01) |
| *C21D 9/46* | (2006.01) |
| *C22C 38/00* | (2006.01) |
| *C22C 38/02* | (2006.01) |

(52) U.S. Cl. ..... 148/504; 148/320; 148/330

(58) Field of Classification Search ..... 148/504, 148/337, 320, 333, 336, 332, 331, 330
See application file for complete search history.

(56) References Cited

U.S. PATENT DOCUMENTS

2003/0063996 A1 4/2003 Funakawa et al.

(Continued)

FOREIGN PATENT DOCUMENTS

EP 1 857 562 A1 11/2007

(Continued)

OTHER PUBLICATIONS

"Recent Research on Bainitic Microstructures and Transformation Behavior of (Very) Low Carbon HSLA Steels-Final Report of Bainite Research Committee", Bainite Research Committee, Society on Basic Research, The Iron and Steel Institute of Japan, Jul. 30, 1994, published by the Iron and Steel Institute of Japan, with an English abstract thereof.

(Continued)

*Primary Examiner* — Jessica L Ward
*Assistant Examiner* — Alexander Polyansky
(74) *Attorney, Agent, or Firm* — Birch, Stewart, Kolasch & Birch, LLP

(57) ABSTRACT

This hot rolled steel contains, in terms of mass %, C: 0.01 to 0.1%, Si: 0.01 to 0.1%, Mn: 0.1 to 3%, P: not more than 0.1%, S: not more than 0.03%, Al: 0.001 to 1%, N: not more than 0.01%, Nb: 0.005 to 0.08%, and Ti: 0.001 to 0.2%, with a remainder being iron and unavoidable impurities, wherein a formula: $[Nb]\times[C]\leqq 4.34\times10^{-3}$ is satisfied, a grain boundary density of solid solution C is not less than 1 atom/nm$^2$ and not more than 4.5 atoms/nm$^2$, and a grain size of cementite grains precipitated at grain boundaries within the steel sheet is not more than 1 μm.

8 Claims, 5 Drawing Sheets

U.S. PATENT DOCUMENTS

2010/0000633 A1* 1/2010 Yokoi et al. ..... 148/504

FOREIGN PATENT DOCUMENTS

JP 6-293910 A 10/1994
JP 2002-322540 A 11/2002
JP 2002-322541 A 11/2002
JP 2002322542 A * 11/2002
JP 2004-43884 A 2/2004
JP 2006-199979 A 8/2006
JP 2007-247049 A 9/2007
WO WO 2006077760 A1 * 7/2006

OTHER PUBLICATIONS

Tadayoshi Wada et al., "Impact Pressure of Water in Hydraulic Descaling during Hot Strip Mill Rolling", Iron and Steel, vol. 77, No. 9, pp. 1450-1457, Sep. 1991, with an English abstract thereof.

* cited by examiner

HIGH-STRENGTH HOT ROLLED STEEL SHEET BEING FREE FROM PEELING AND EXCELLENT IN SURFACE PROPERTIES AND BURRING PROPERTIES, AND METHOD FOR MANUFACTURING THE SAME

TECHNICAL FIELD

The present invention relates to a high-strength hot rolled steel sheet having excellent surface properties and burring properties, and a process for manufacturing the same.

This application claims priority on Japanese Patent Application No. 2007-82567 filed on Mar. 27, 2007, the content of which is incorporated herein by reference.

BACKGROUND ART

In recent years, increasing of the strength of iron alloy steel sheets and increasing of the use of lightweight metals such as Al alloys are being actively promoted for the purpose of reducing the weight of all manner of steel sheets for reasons such as an improvement of the fuel consumption of motor vehicles, and the like. Compared with heavy metals such as steels, lightweight metals such as Al alloys offer the advantage of a high specific strength; however, they tend to be extremely expensive, and therefore the use of such lightweight metals tends to be limited to special applications. Accordingly, in order to enable weight reduction of all manner of steel sheets to be implemented cheaply and across a broad range of steels, the strength of the steel sheets must be increased.

Because strengthening of a steel sheet is generally accompanied by a deterioration in the material properties such as the moldability (formability) and the like, an important challenge in the development of high-strength steel sheets is how to best achieve an increase in the strength without impairing the material properties. Particularly in the case of steel sheets used for motor vehicle components such as inner sheet members, structural members, underbody members, and the like, properties such as stretch flange formability, burring formability, ductility, fatigue durability, corrosion resistance, and the like are required, and how to best achieve a high degree of balance between these material properties and superior strength properties is very important.

For example, the steel sheets used in motor vehicle members such as structural members and underbody members which account for approximately 20% of the vehicle weight, are typically subjected to blanking and hole formation by shearing and punching processes, and subsequently subjected to press forming that includes mainly stretch flange formation and burring processes. Therefore, the steel sheets must satisfy an extremely stringent hole expandability (λ value) requirement.

Furthermore, in the steel sheets used for these types of members, there is a common concern that flaws or microcracks may occur on the end faces formed by the shearing or the punching processing, and that these flaws or microcracks may then develop into cracks that lead to fatigue breakdown. As a result, in order to improve the fatigue durability at the end faces of the above types of steel materials, it is necessary to ensure that flaws or microcracks do not occur.

As illustrated in FIG. 1, these flaws and microcracks that occur at the end faces tend to result in cracking in a direction parallel to the sheet thickness direction of the end face. This type of cracking is termed "peeling". In FIG. 1, the surface of the circular cylinder represents a surface in the sheet thickness direction, and the cracking that occurs parallel to this circular cylindrical surface is termed "peeling".

This "peeling" occurs in approximately 80% of cases for steel sheets having strength in the order of 540 MPa, and occurs in substantially 100% of cases for steel sheets having strength in the order of 780 MPa. Further, this "peeling" occurs irrespective of the hole expanding ratio (λ). For example, "peeling" occurs regardless of whether the hole expanding ratio is 50% or 100%.

Moreover, the steel sheet used for motor vehicle members such as seat rails, seatbelt buckles, wheel discs, and the like must be a high-strength steel sheet that exhibits superior esthetic appearance and superior design properties as well as excellent formability. As a result, the various steel sheets used in motor vehicle components and the like not only require the material properties described above, but may also require a stringent level of surface quality depending on the application of the steel sheet.

In order to achieve a combination of high strength and various material properties, and particularly formability, manufacturing processes have been disclosed in which, by ensuring that 90% or more of the steel microstructures are ferrite and the remainder are bainite, a steel sheet can be produced that exhibits a combination of high strength and superior ductility and hole expandability (for example, see Patent Document 1).

However, since a steel sheet manufactured using the techniques disclosed in Patent Document 1 contains 0.3% or more of Si, a tiger-striped scale pattern known as "red scale" (Si scale) tends to be generated on the surface of the steel sheet. Therefore, it is difficult to apply the steel sheet to motor vehicle components that require a strict surface quality.

Moreover, investigations by the inventors of the present invention revealed that steels having the composition disclosed in Patent Document 1 suffer from "peeling" after a punching process.

In order to address this problem, techniques have been disclosed in which, by suppressing the added amount of Si to not more than 0.3% to inhibit the occurrence of red scale, and adding Mo to reduce the size of precipitates, a high-tensile hot rolled steel sheet is obtained that has superior strength while also achieving excellent stretch flange formability (for example, see Patent Documents 2 and 3).

In the steel sheets prepared using the techniques disclosed in Patent Documents 2 and 3, although the amount of added Si is not more than approximately 0.3%, it is difficult to satisfactorily suppress the generation of red scale. And because the techniques also require the addition of 0.07% or more of Mo which is the expensive alloy element, the manufacturing costs tend to be high.

Moreover, investigations by the inventors of the present invention revealed that steels having a composition disclosed in Patent Document 2 or 3 suffer from "peeling" after a punching process.

The techniques disclosed in Patent Documents 2 and 3 make absolutely no comment relating to techniques for suppressing the occurrence of flaws or microcracks on the end faces formed by shearing or punching processing.

Patent Document 1: Japanese Unexamined Patent Application, First Publication No. H06-293910

Patent Document 2: Japanese Unexamined Patent Application, First Publication No. 2002-322540

Patent Document 3: Japanese Unexamined Patent Application, First Publication No. 2002-322541

DISCLOSURE OF INVENTION

Problems to be Solved by the Invention

The present invention has been proposed in light of the issues described above, and an object of the present invention is to provide a high-strength hot rolled steel sheet having excellent surface properties and burring properties, which has a high degree of strength but can still be applied to members that must satisfy stringent requirements of formability and hole expandability, exhibits excellent surface properties with no external appearance degradation such as Si scale on the surface of the member, and is a steel sheet having a strength of 540 MPa or higher, or a steel sheet having a strength of 780 MPa or higher, that exhibits excellent durability to cracking ("peeling") at an end face formed by shearing or punching processing. Another object of the present invention is to provide a manufacturing process capable of manufacturing this steel sheet in a cheap and stable manner.

In the present invention, the expression of "excellent burring properties" refers to a steel for which no "peeling" occurs at the end face, and for which testing using the hole expansion test method prescribed in the Japan Iron and Steel Federation Standard JFS T 1001-1996 yields a hole expanding ratio of 135% or greater for a steel sheet having strength of 540 MPa and a hole expanding ratio of 90% or greater for a steel sheet having strength of 780 MPa or higher.

Means to Solve the Problems

In order to achieve the above objects, the inventors of the present invention realized the following high-strength hot rolled steel sheet having excellent surface properties and excellent burring properties.

A high-strength hot rolled steel sheet free from peeling and excellent in surface properties and burring properties according to the present invention contains, in mass % values, C: 0.01 to 0.1%, Si: 0.01 to 0.1%, Mn: 0.1 to 3%, P: not more than 0.1%, S: not more than 0.03%, Al: 0.001 to 1%, N: not more than 0.01%, Nb: 0.005 to 0.08%, and Ti: 0.001 to 0.2%, with a remainder being iron and unavoidable impurities, wherein if the Nb content is represented by [Nb] and the C content is represented by [C], then the steel sheet satisfies the formula below:

$$[Nb]\times[C]\leqq 4.34\times 10^{-3},$$

a grain boundary density of solid solution C (atom density of solid solution C at grain boundaries) is not less than 1 atom/$nm^2$ and not more than 4.5 atoms/$nm^2$, and a grain size of cementite (cementite grains) precipitated at grain boundaries within the steel sheet is not more than 1 μm.

In the hot rolled steel sheet of the present invention, the element contents may satisfy C: 0.01 to 0.07%, Mn: 0.1 to 2%, Nb: 0.005 to 0.05%, and Ti: 0.001 to 0.06%, wherein if the Si content is represented by [Si] and the Ti content is represented by [Ti], then the steel sheet may satisfy the formula below:

$$3\times[Si]\geqq[C]-(12/48[Ti]+12/93[Nb]),\text{ and}$$

a tensile strength may be in a range from 540 MPa to less than 780 MPa.

The element content levels may satisfy C: 0.03 to 0.1%, Si: $0.01\leqq Si\leqq 0.1$, Mn: 0.8 to 2.6%, Nb: 0.01 to 0.08%, and Ti: 0.04 to 0.2%, wherein if the Ti content is represented by [Ti], then the steel sheet may satisfy the formula below:

$$0.0005\leqq[C]-(12/48[Ti]+12/93[Nb])\leqq 0.005,\text{ and}$$

the tensile strength may be at least 780 MPa.

The steel sheet may further include, in mass % values, one or more elements selected from Cu: 0.2 to 1.2%, Ni: 0.1 to 0.6%, Mo: 0.05 to 1%, V: 0.02 to 0.2%, and Cr: 0.01 to 1%.

The steel sheet may further include, in mass % values, either or both of Ca: 0.0005 to 0.005% and REM: 0.0005 to 0.02%.

The steel sheet may further include, in a mass % value, B: 0.0002 to 0.002%, and a grain boundary density of the solid solution C and/or solid solution B (atom density of the solid solution C and/or solid solution B at grain boundaries) is not less than 1 atom/$nm^2$ and not more than 4.5 atoms/$nm^2$.

The steel sheet may be galvanized.

A method for manufacturing a high-strength hot rolled steel sheet free from peeling and excellent in surface properties and burring properties according to the present invention includes:

heating a steel slab having the same components as the hot rolled steel sheet of the present invention at a temperature that is not less than a temperature SRTmin (° C.) satisfying a formula shown below and not more than 1,170° C., $$SRTmin=6670/\{2.26-\log([Nb]\times[C])\}-273;$$

performing rough rolling at a finishing temperature of not less than 1,080° C. and not more than 1,150° C.; subsequently commencing finish rolling within not less than 30 seconds and not more than 150 seconds at a temperature of not less than 1,000° C. but less than 1,080° C.; completing the finish rolling within a temperature range from not less than an $Ar_3$ transformation point temperature to not more than 950° C. so as to achieve a final pass reduction ratio of not less than 3% and not more than 15%; and conducting cooling at a cooling rate exceeding 15° C./sec from a cooling start temperature to a temperature within a range from not less than 450° C. to not more than 550° C., then coiling the steel sheet.

In the method for manufacturing a high-strength hot rolled steel sheet free from peeling and excellent in surface and burring properties according to the present invention, the steel sheet obtained after coiling may be subjected to acid washing, and then may be dipped in a galvanizing bath in order to galvanize the surface of the steel sheet.

The steel sheet obtained after galvanizing may be subjected to an alloying treatment.

Effect of the Invention

The present invention relates to a high-strength hot rolled steel sheet having excellent surface properties and excellent burring properties and a method for manufacturing such a steel sheet. This type of steel sheet can be readily applied to members that must satisfy stringent requirements of formability and hole expandability. The steel sheet exhibits excellent surface properties with no external appearance degradation such as Si scale on the surface of the member, and the steel sheet also exhibits excellent durability to cracking ("peeling") at end faces formed by shearing or punching processing. In accordance with the manufacturing process, a steel sheet which has a strength of 540 MPa or higher, or a strength of 780 MPa or higher, and has excellent surface properties and excellent burring properties can be manufactured in a cheap and stable manner. Accordingly, the present invention can be evaluated to have high industrial value.

BEST MODE FOR CARRYING OUT THE INVENTION

Figure 1:
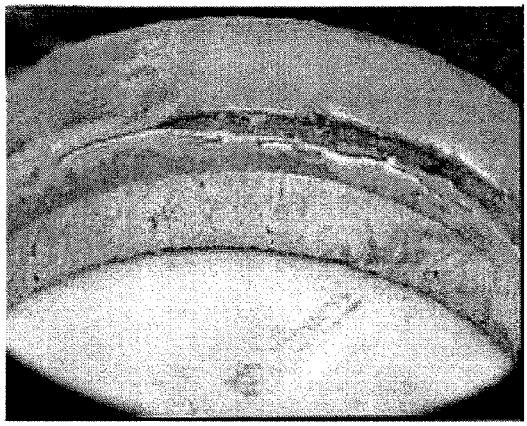
FIG. 1 is a photograph showing a punched out portion viewed from diagonally above the portion.

A detailed description of a high-strength hot rolled steel sheet having excellent surface and burring properties (hereafter referred to as simply "the hot rolled steel sheet") is presented below as a description of the best mode for carrying out the present invention. In the following description, mass % values detailing compositions are simply recorded using "%".

First is a description of the results of the fundamental research undertaken in completing development of the present invention.

The inventors of the present invention conducted various tests to ascertain the effects that metallurgical factors such as the materials, composition and microstructures of a hot rolled steel sheet exert on both of microcracks that occur at member end faces formed by shearing or punching processing (hereafter these flaws or microcracks are described using the generic terms "peeling" (or "fracture surface cracking"), and the occurrence of Si scale. The results obtained are described below.

In high-strength steel sheets in which "peeling" had occurred, when the microstructure was observed after treating the steel sheet with a nital etching solution, no grain boundaries were detected.

In high-strength steel sheets having no "peeling", when the microstructure was observed after treating the steel sheet with a nital etching solution, grain boundaries were sometimes detected and sometimes not.

In interstitial-free (atoms) steels (IF steels), "peeling" did not occur. However, when the microstructure was observed after treating this steel sheet with a nital etching solution, grain boundaries were not detected, and the hole expanding ratio was high.

From the above results, it was determined that "peeling" does not exhibit a primary correlation with the detection of grain boundaries using a nital etching solution.

Accordingly, further tests were conducted to determine more detailed relationships for "peeling".

A detailed description of the tests for a detailed investigation of the crystal grain boundaries and the results of those tests are presented below, but as is evident in FIG. 2, the density of solid solution C present at the crystal grain boundaries and the occurrence of "peeling" are related.

In order to investigate details of this relationship, the tests described below were conducted.

First, steel slabs containing the steel components shown in Table 1 were melted, and hot rolled steel sheets of thickness 2 mm were prepared by the manufacturing process for the hot rolled steel sheet under various coiling temperatures. Each of the thus obtained hot rolled steel sheets was investigated for the existence or absence of fracture surface cracking (peeling) in terms of the relationship between the coiling temperature and the grain boundary density of solid solution C and/or solid solution B, the relationship between the grain size of the grain boundary cementite precipitated at the grain boundaries and the hole expansion value, and the relationship between the coiling temperature and the grain size of the grain boundary cementite. In this description, the symbol 1* in the tables represents the value of [C]−(12/48[Ti]+12/93[Nb]), and the symbol 2* represents the value of 3×[Si]−{[C]−(12/48[Ti]+12/93[Nb])}. In the tables, [C] represents the C content, [Ti] represents the Ti content, [Nb] represents the Nb content and [Si] represents the Si content.

TABLE 1

| | Chemical composition (units: mass %) | | | | | | | | | | | | |
|---|---|---|---|---|---|---|---|---|---|---|---|---|---|
| Steel | C | Si | Mn | P | S | Al | N | Nb | Ti | B | [Nb] × [C] | 1* | 2* |
| A | 0.045 | 0.06 | 1.22 | 0.012 | 0.004 | 0.037 | 0.0038 | 0.045 | 0.033 | — | 0.00203 | 0.0309 | 0.1491 |
| B | 0.043 | 0.07 | 1.24 | 0.011 | 0.005 | 0.041 | 0.0035 | 0.043 | 0.036 | 0.007 | 0.00185 | 0.0285 | 0.1815 |

In these investigations, the hole expansion value (hole expanding ratio), fracture surface cracking (peeling), grain size of grain boundary cementite, and grain boundary segregation density were evaluated in accordance with the methods described below.

The hole expansion value was evaluated in accordance with the hole expansion test method prescribed in the Japan Iron and Steel Federation Standard JFS T 1001-1996. Further, the existence or absence of fracture surface cracking was determined by punching out the steel sheet with a clearance of 20% using the same method as the hole expansion test method prescribed in the Japan Iron and Steel Federation Standard JFS T 1001-1996, and then visually examining the punched out surface.

A sample was cut from a position of ¼ W or ¾ W across the width of the steel sheet of the sample steel. Then, a sample for observing by a transmission electron microscope was taken from ¼ thickness of the cut sample, and was observed using a transmission electron microscope fitted with a field emission gun (FEG) having an accelerating voltage of 200 kV. The precipitates observed at the grain boundaries were confirmed as cementite by analysis of the diffraction pattern. In this investigation, the grain sizes were measured for all the grain boundary cementite particles observed in a single field of view, and the grain size of grain boundary cementite is defined as the average value of the measured grain size values.

In order to measure the solid solution C that exists at the grain boundaries and within the grains, a three dimensional atom probe method was used. A position sensitive atom probe (PoSAP), which was developed in 1988 by A. Cerezo et al. at Oxford University is an apparatus in which a position sensitive detector is incorporated in the detector of an atom probe, and during analysis, is capable of simultaneously measuring the flight time and the position of atoms reaching the detector without using an aperture. By employing this apparatus, not only can all the compositional elements within the alloy in the sample surface be displayed with atomic-level spatial resolution using a two dimensional map, but a three dimensional map can also be displayed and analyzed by using the field evaporation phenomenon to evaporate one atomic layer at a time from the sample surface, and expanding the two dimensional map in the thickness direction. In order to observe the grain boundaries, a needle-shaped AP sample containing grain boundaries was prepared by using an FIB (focused ion beam) apparatus/FB2000A manufactured by Hitachi, Ltd as follows. The cut sample was fainted into a needle shape such that the grain boundary was situated at the tip of the needle by electrolytic polishing using a scanning beam having an arbitrary shape. Crystal grains of different orientations exhibit contrast due to an SIM (scanning ion microscope) channeling phenomenon, and therefore the sample was observed under an SIM to identify a grain boundary and then cut using an ion beam. Using an OTAP apparatus manufactured by Cameca as the three dimensional atom probe apparatus, measurement was conducted under conditions including a sample location temperature of approximately 70 K, a probe total voltage of 10 to 15 kV and a pulse ratio of 25%. The grain boundary and the grain interior of each sample were measured three times, and the average value was recorded as a representative value. The value obtained by subtracting background noise and the like from the measured value was defined as the atom density per unit area of grain boundary, and this result was recorded as the grain boundary density (grain boundary segregation density) (number/$nm^2$).

Accordingly, the solid solution C that exists at the grain boundaries is quite simply the C atom that exists at the grain boundaries.

In the present invention, the grain boundary density of solid solution C is defined as the number (density) of solid-solubilized C atoms that exist at the grain boundary per unit area of grain boundary.

Because the atom map reveals the distribution of atoms in three dimensions, it can be confirmed that the number of C atoms at the crystal grain boundaries is large. In the case of a precipitate, the precipitate can be identified by the number of atoms and the positional relationship relative to other atoms (such as Ti).

In the steels containing the components shown in Table 1, it was confirmed that almost no solid solution C existed and most C atoms existed as precipitates with Ti and Nb.

Figure 2:
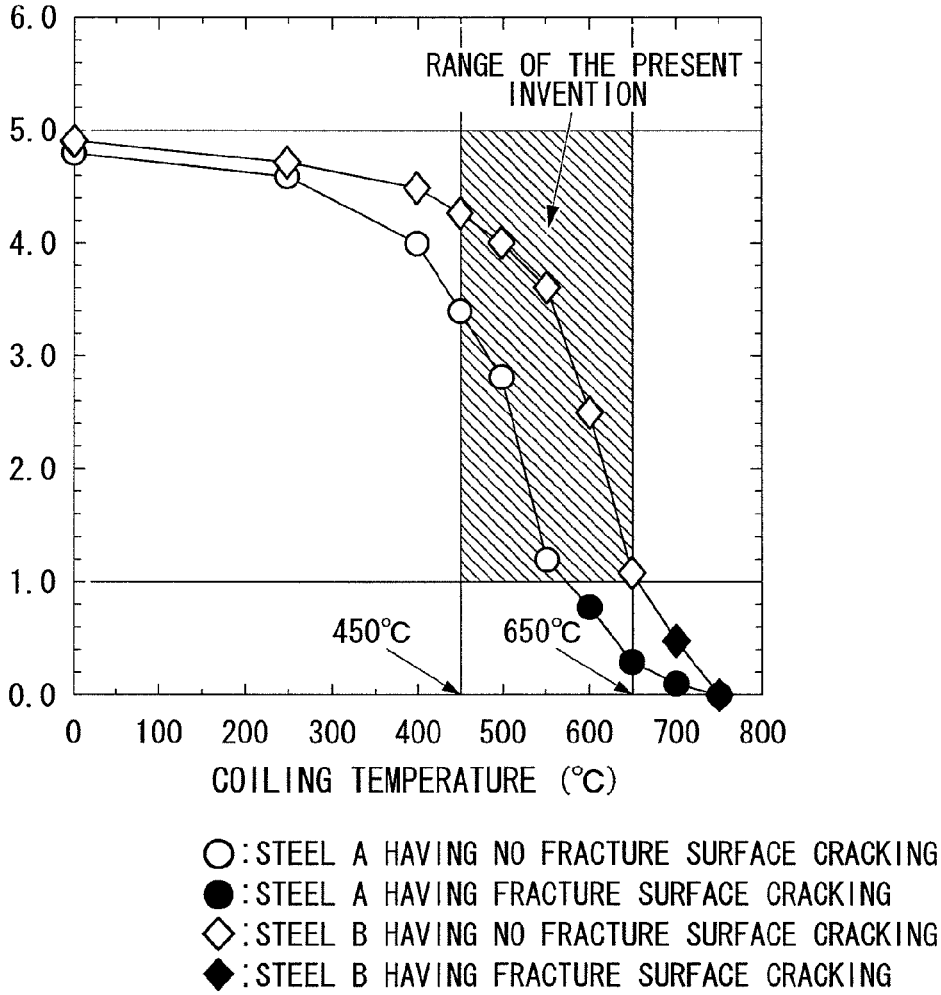
FIG. 2 is a graph illustrating the existence or absence of fracture surface cracking in the relationship between the grain boundary segregation density (grain boundary density) of solid solution C and solid solution B and the coiling temperature.

FIG. 2 is a graph illustrating the existence or absence of "peeling" (fracture surface cracking) in the relationship between the grain boundary density of solid solution C and solid solution B and the coiling temperature.

From FIG. 2, it is clear that the coiling temperature and the grain boundary density of solid solution C and solid solution B exhibit an extremely strong correlation. In a new finding, it was discovered that in the case where the coiling temperature was 550° C. or lower for a steel A containing no added B, and in the case where the a coiling temperature was 650° C. or lower for a steel B containing added B, the grain boundary density of solid solution C and solid solution B was at least 1 atom/$nm^2$, and "peeling" (fracture surface cracking) could be prevented.

In the steel A, if the coiling temperature exceeded 550° C., then the solid solution C that had been segregated at the grain boundaries tended to be precipitated within the grains as TiC after coiling, and the grain boundary density of solid solution C fell to less than 1 atom/$nm^2$. As a result, the strength of the grain boundaries decreased relative to the grain interior, and it is envisaged that this causes grain boundary cracking during punching or shearing processes, resulting in fracture surface cracking.

The fact that B is segregated at the grain boundaries is well known, and based on the information illustrated in FIG. 2, it would appear that by adding B, an increase in the grain boundary density of solid solution B was approximately 1 atom/$nm^2$. In those cases where B exists, the number of the solid solution B at the grain boundaries must be added to the number of the solid solution C in calculating the grain boundary density.

Figure 3:
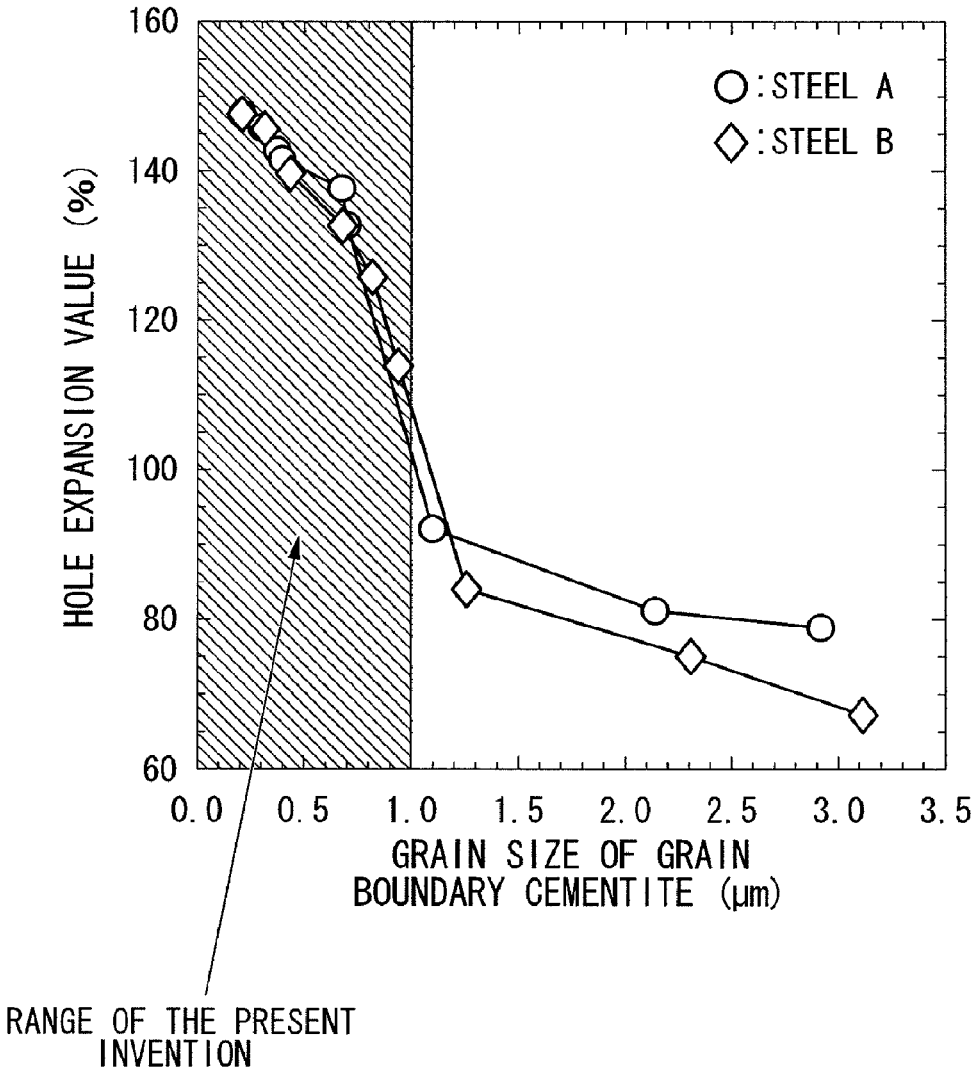
FIG. 3 is a graph illustrating the relationship between the hole expansion value and the grain size of grain boundary cementite.

FIG. 3 is a graph illustrating the relationship between the hole expansion value and the grain size of the cementite that exists at the grain boundaries. From FIG. 3, it was evident that the hole expansion value and the grain size of the cementite that exists at the grain boundaries exhibited an extremely strong correlation.

Moreover, in a new finding, it was discovered that when the grain size of the cementite that existed at the grain boundaries was 1 μm or smaller, the hole expansion value increased significantly.

As shown in FIG. 2, both of the steel A and the steel B contain solid solution C at the grain boundaries. Accordingly, an investigation was conducted into the relationship between the grain boundary density and the grain size of the cementite that exists at the grain boundaries.

Figure 4:
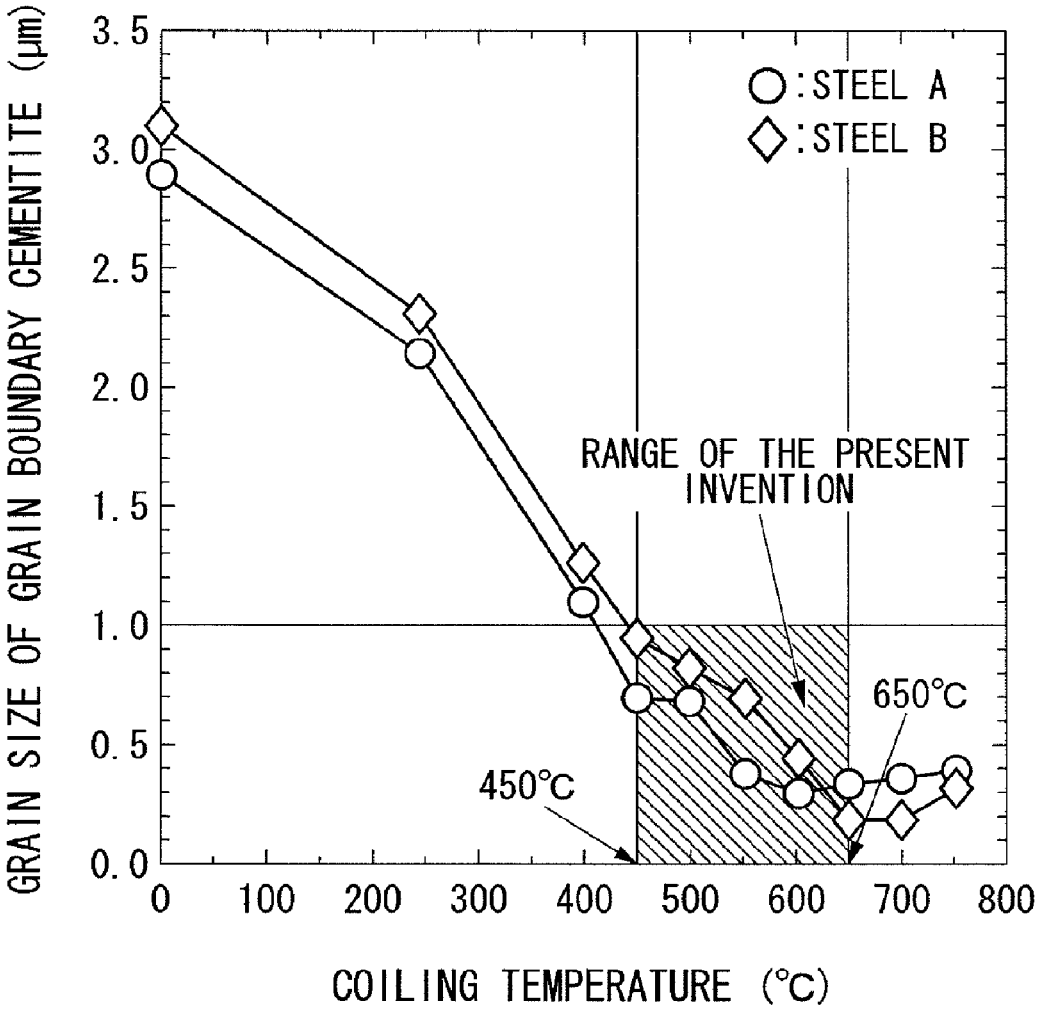
FIG. 4 is a graph illustrating the relationship between the grain size of grain boundary cementite and the coiling temperature.

FIG. 4 is a graph illustrating the relationship between the grain size of grain boundary cementite and the coiling temperature. From FIG. 4, it is evident that the coiling temperature and the grain size of the cementite precipitated at the grain boundaries exhibit an extremely strong correlation. In a new finding, it was discovered that when a coiling temperature was 450° C. or higher, a grain size of grain boundary cementite was 1 μm or less.

In other words, it was discovered that when the grain boundary density was not more than 4.5 atoms/$nm^2$, the cementite grain size was 1 μm or less.

From the above results, it was discovered that ensuring a grain boundary density of not less than 1 atom/$nm^2$ and not more than 4.5 atoms/$nm^2$ represented particularly favorable conditions for preventing the occurrence of "peeling" and improving the hole expansion value.

The discovery that the hole expanding ratio is even further improved when the grain size of the cementite that exists at the grain boundaries is 1 μm or less is thought to be due to the reasons described below.

First, it is thought that the stretch flange formability and the burring formability that are represented by the hole expansion value are affected by voids that act as the origins for cracking generated during punching or shearing processing.

It is thought that in those cases where the cementite phase precipitated at the main phase grain boundaries is reasonably large compared with the main phase grains, the main phase grains are subjected to excessive stress in the vicinity of the main phase grain boundaries; thereby, those voids are generated. However, it is thought that in those cases where the grain size of the grain boundary cementite is not more than 1 μm, the cementite grains are relatively small compared with the main phase grains, and no mechanical stress concentration occurs; therefore, voids are unlikely to occur, thus the hole expansion value is improved.

Next, under the premise of improving the hole expanding ratio while preventing the occurrence of "peeling", the inventors of the present invention melted a series of steel slabs containing the steel components shown in Table 2 that included a varied amount of added Si, and hot rolled steel sheets having a thickness of 2 mm were prepared by the manufacturing process for the hot rolled steel sheet under various heating temperatures for the slab heating conducted prior to rolling. The inventors of the present invention investigated each of the thus obtained hot rolled steel sheets for the existence or absence of Si scale in terms of the relationship between the heating temperature and the Si content, and also investigated the relationship between the heating temperature and the tensile strength.

TABLE 2

| Steel | Chemical composition (units: mass %) | | | | | | | | | | [Nb] × [C] | Solution temperature (° C.) | 1* | 2* |
|---|---|---|---|---|---|---|---|---|---|---|---|---|---|---|
| | C | Si | Mn | P | S | Al | N | Nb | Ti | B | | | | |
| C | 0.045 | 0.02 | 1.22 | 0.011 | 0.004 | 0.038 | 0.0038 | 0.045 | 0.033 | — | 0.00203 | 1074 | 0.0309 | 0.0291 |
| D | 0.044 | 0.08 | 1.21 | 0.012 | 0.006 | 0.035 | 0.0041 | 0.045 | 0.031 | — | 0.00198 | 1071 | 0.0304 | 0.2096 |
| E | 0.043 | 0.11 | 1.22 | 0.01 | 0.006 | 0.033 | 0.004 | 0.046 | 0.035 | — | 0.00198 | 1071 | 0.0283 | 0.3017 |
| F | 0.043 | 0.27 | 1.24 | 0.011 | 0.005 | 0.041 | 0.0035 | 0.043 | 0.036 | — | 0.00185 | 1063 | 0.0285 | 0.7815 |

The presence or absence of Si scale was confirmed by visual observation after acid washing. Further, the tensile strength was measured by cutting a No. 5 test piece prescribed in JIS Z 2201 from each steel sheet, and then measuring the tensile strength using the tensile test method prescribed in JIS Z 2201.

Figure 5:
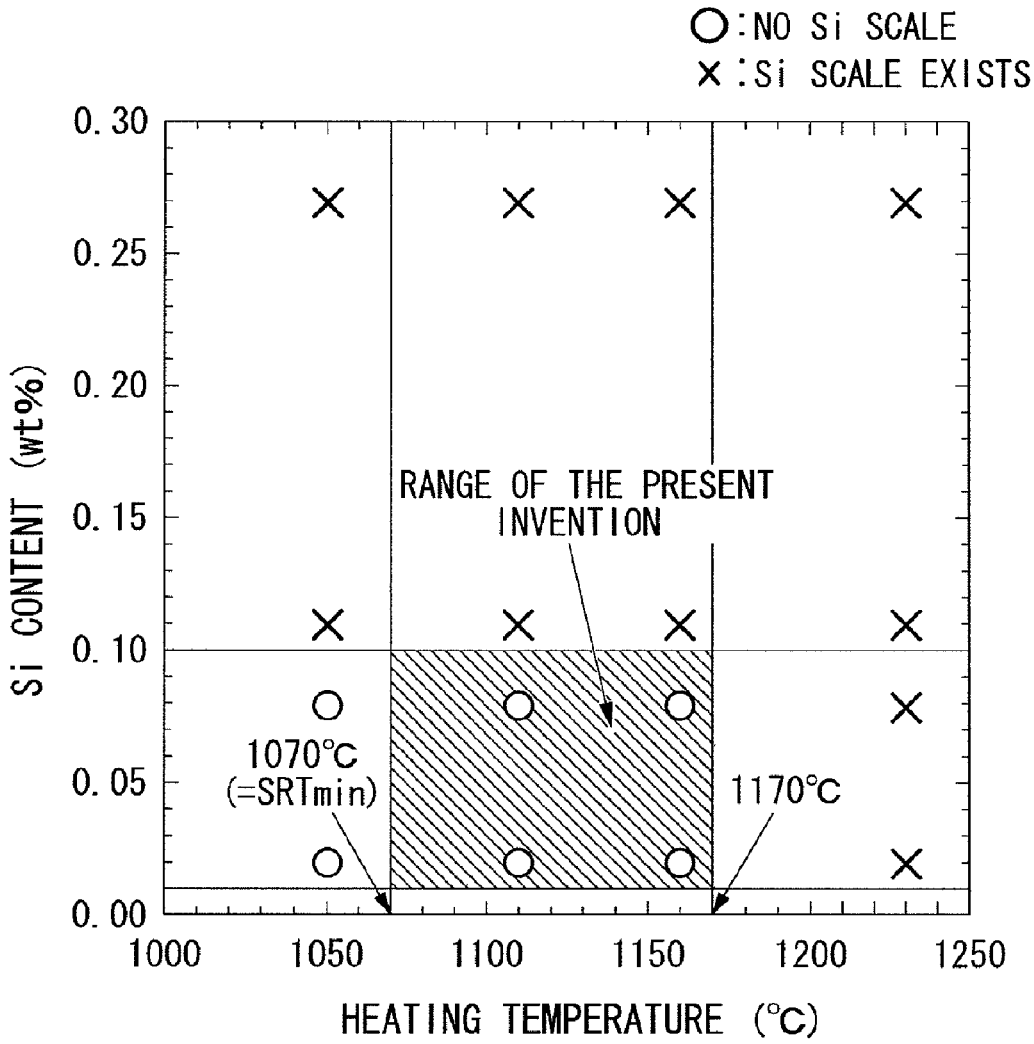
FIG. 5 is a diagram illustrating the existence or absence of Si scale in the relationship between the Si content and the heating temperature.

FIG. 5 illustrates the existence or absence of Si scale in the relationship between the Si content and the heating temperature. From FIG. 5, it was evident that if the steel sheet contained more than 0.1% of Si, then Si scale occurred regardless of the heating temperature. Further, from FIG. 5, it was also confirmed that even in the case where the Si content of the steel sheet was 0.1% or less, if the heating temperature exceeded 1,170° C., then Si scale occurred in a similar manner to that observed in the case where the Si content exceeded 0.1%.

Furthermore, in the case where the heating temperature was not more than 1,170° C., it was confirmed that unlike the results observed when the Si content exceeded 0.1%, if the Si content was 0.1% or less, then Si scale did not occur.

Si scale appears as a red-brown islands-like pattern on the steel sheet surface after hot rolling, and causes a marked deterioration in the quality of the external appearance of the steel sheet. Further, because the Si scale forms asperity on the steel sheet surface, the islands-like pattern remains even after acid washing, and this causes a marked deterioration in the surface properties including the external appearance. It is thought that this asperity that develops on the surface of a Si-containing steel is caused by fayalite $Fe_2SiO_2$ which is a compound generated by a reaction between Si oxides and iron oxides. Furthermore, it is thought that the Si scale (red scale) that is generated in those cases where the Si content is relatively small, which seems to make it very difficult to remove scales during subsequent descaling, is due to liquid phase oxides that is generated at a high temperature of not less than 1,170° C. that represents the eutectic point of fayalite and wustite FeO.

Figure 6:
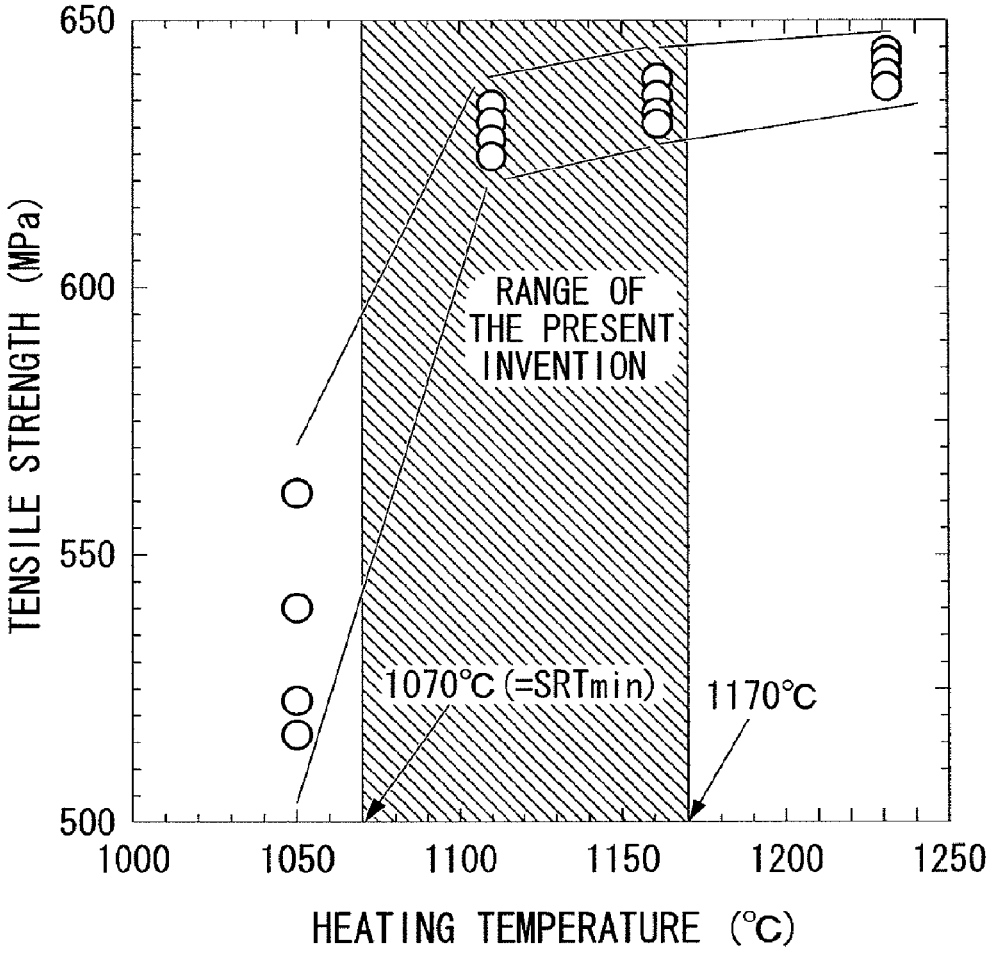
FIG. 6 is a graph illustrating the relationship between the tensile strength of the steel sheet and the heating temperature.

FIG. 6 illustrates the relationship between the tensile strength of the steel sheet and the heating temperature.

The components of the steel sheets shown in FIG. 6 are those of C to F in Table 2.

From FIG. 6, it was clear that the heating temperature and the tensile strength of the steel sheet exhibited an extremely strong correlation. In other words, it was discovered that even within the temperature range of 1,170° C. or lower, the slab reheating temperature (SRT) during the slab heating step of the present invention has a minimum temperature SRTmin=1,070° C. at which a predetermined tensile strength can still be obtained.

This minimum slab reheating temperature (SRTmin) is calculated using the numerical formula (A) shown below, and it was clear that when the temperature was not less than the minimum slab reheating temperature (SRTmin), the tensile strength increased considerably.

In the numerical formula below, the Nb content (%) is represented by [Nb], the C content (%) is represented by [C], and SRTmin is calculated by determining the solution temperature for the complex precipitate of TiNbCN from the product of Nb and C.

$$SRTmin=6670/\{2.26-\log([Nb]\times[C])\}-273 \quad (A)$$

The conditions required for obtaining the complex precipitate of TiNbCN are determined by the amount of Ti. Namely, if the amount of Ti is small, then lone precipitation of TiN is eliminated.

For example, for steels in which the amount of Ti is not less than 0.001% but less than 0.060%, the following formula is satisfied.

$$0.0005 \leqq [C]-(12/48[Ti]+12/93[Nb]) \leqq 0.040$$

For steels in which the amount of Ti is not less than 0.040% and not more than 0.2%, the following formula is satisfied.

$$0.0005 \leqq [C]-(12/48[Ti]+12/93[Nb]) \leqq 0.0050$$

By altering the components within the above range, the complex precipitate of TiNbCN can be produced in a stable manner.

The finding that the tensile strength of the steel sheet increases markedly when the temperature is not less than the temperature SRTmin that satisfies the above numerical formula (A) is due to the reason described below.

Namely, in order to achieve the targeted tensile strength, precipitation strengthening due to Nb and Ti must be effectively utilized. These elements Nb and Ti are precipitated as coarse carbonitrides such as TiN, NbC, TiC and NbTi(CN) in the slab prior to heating.

TiC also substantially melts at the solution temperature of Nb.

It was discovered that because Ti exists as the complex precipitate of TiNbCN within the slab, the solution temperature becomes much lower than that observed for lone Ti; thereby, solution treatment can be conducted while suppressing the generation of fayalite. In the conventional case where lone Ti exists, solution treatment is conducted at an extremely high temperature; thereby, simultaneous suppression of fayalite generation can no longer be achieved.

In order to obtain precipitation strengthening due to Nb and Ti effectively, the coarse carbonitrides mentioned above must be solid-solubilized adequately into the base material during the slab heating step. The vast majority of the Nb and Ti carbonitrides melt at the solution temperature of Nb. Accordingly, it was discovered that in order to achieve the targeted tensile strength, the slab must be heated to the solution temperature of Nb (=SRTmin) during the slab heating step.

Considering the typical literature value of solubility product provided for each of TiN, TiC, NbN and NbC, and the fact that the precipitation of TiN occurs at a high temperature, it was assumed that it is difficult to melt Nb and Ti carbonitrides by a low-temperature heating applied in the present invention.

However, the inventors of the present invention discovered that almost all of TiC melted simply by the solution treatment of NbC as described above.

When a precipitated material which is believed to be a TiNb(CN) complex precipitate is observed by replica observation using a transmission electron microscope, it is found that the concentration proportions of Ti, Nb, C and N differ between the central portion precipitated at high temperatures and the outer shell portion that was thought to be precipitated at comparatively low temperatures. Namely, the concentration proportions of Ti and N were high in the central portion; in contrast, those of Nb and C were high in the outer shell portion. This is because TiNb(CN) is an MC precipitate having an NaCl structure, and in the case of NbC, although Nb is coordinated at the M site and C is coordinated at the C site, variations in the temperature can cause substitution of Nb with Ti, and substitution of C with N. This also applies for TiN. Even at a temperature where NbC melts completely, Nb is still incorporated within TiN at a site fraction of 10 to 30%, and therefore strictly speaking, Nb is completely solid-solubilized at a temperature of not less than the temperature where TiN melts completely. However, in a component system where the added amount of Ti is comparatively small, this solution temperature may be set to the substantive lower limit temperature at which Nb precipitates melt. Furthermore, the above explanation also applies to TiC, so that although Ti is coordinated at the M site, a proportion of Ti is substituted with Nb at lower temperatures. Accordingly, the solution temperature of the complex precipitate of TiNbCN may be set to the substantive solution temperature of TiC.

Based on the findings resulting from these experimental investigations, the inventors of the present invention first considered the conditions relating to the chemical components of steel sheets, and as a result, they were able to complete the present invention.

The reasons for restricting the chemical components in the present invention are described below.

(1) C: 0.01 to 0.1%

C exists at the crystal grain boundaries, has an effect of suppressing "peeling" (fracture surface cracking) at end faces formed by shearing or punching processes, and is an element that contributes to an improvement of the strength due to precipitation strengthening by bonding with Nb, Ti and the like to form precipitates within the steel sheet. If the C content is less than 0.01%, then the above effects cannot be achieved, whereas if the C content exceeds 0.1%, then the amount of carbides that may function as the origin of burring cracking tends to increase, and the hole expansion value deteriorates. Accordingly, the C content is restricted to an amount of not less than 0.01% and not more than 0.1%. Further, if consideration is given to improving the ductility as well as improving the strength, then the C content is preferably within a range of less than 0.07%, and is more preferably within a range of not less than 0.035% and not more than 0.05%.

A preferred range in the case of a steel sheet having a tensile strength of at least 540 MPa is C: 0.01 to 0.07%, and a preferred range in the case of a steel sheet having a tensile strength of at least 780 MPa is C: 0.03 to 0.1%.

(2) Si: 0.01 to 0.1%

Si is an element that has the effect of suppressing the formation of scale-based defects such as fish-scale defects and spindle-shaped scale. This effect is achieved when the Si content is at least 0.01%. However if Si is added at an amount exceeding 0.1%, then not only is the above effect saturated, but also tiger-striped Si scale tends to be generated on the surface of the steel sheet, and therefore, it results in a deterioration in the surface properties. Accordingly, the Si content is restricted to an amount of not less than 0.01% and not more than 0.1%. The Si content is preferably within a range of not less than 0.031% and not more than 0.089%. Si also has an effect of inhibiting the precipitation of iron-based carbides such as cementite within the material microstructure, and contributing to an improvement in the ductility, and this effect increases as the Si content increases. However, from the viewpoint of preventing Si scale, there is an upper limit to how much Si can be added. Accordingly, in order to inhibit carbide precipitation, additions of Nb and Ti and the manufacturing process conditions must be employed as described below.

A preferred range in the case of a steel sheet having a tensile strength of at least 540 MPa but less than 780 MPa is $[Si] \leqq 0.1$ and the formula shown below is also preferably satisfied.

$$3 \times [Si] \geqq [C] - (12/48[Ti] + 12/93[Nb])$$

In order for Si to inhibit the precipitation of iron-based carbides such as cementite in the manner described above, and to contribute to an improvement in ductility, the stoichiometric composition of C which is not fixed as precipitates with Ti, Nb or the like must satisfy the relationship in the above formula. When the relationship of the above formula is satisfied, precipitation as cementite is inhibited; thereby, any decrease in ductility can be suppressed. However, if the amount of Si is further increased, then the atom density (number density) of C that exists at the grain boundaries tends to readily fall below 1 atom/nm$^2$, and therefore the upper limit for the Si content is set to 0.1%.

In a steel sheet having a tensile strength of at least 540 MPa but less than 780 MPa, because the amounts of alloy elements such as Ti and Nb are relatively small, cementite and the like are generated comparatively easily, and therefore, the regulation imparted by Si in accordance with the above formula is particularly effective.

In particular, if the Si content is small and does not satisfy the range specified by the above formula, then cementite precipitation occurs; thereby, the burring properties tend to deteriorate.

On the other hand, in the case of a steel sheet having comparatively large amounts of Ti and Nb as well as having a tensile strength of 780 MPa or higher, a preferred component range is Si: $0.01 \leqq Si \leqq 0.1$.

As the amount of Si increases, the atom density of C that exists at the grain boundaries tends to readily fall below 1 atom/nm$^2$, and therefore the upper limit for the Si content is set to 0.1%.

(3) Mn: 0.1 to 3%

Mn is an element that contributes to an improvement of the strength due to solid solution strengthening and hardening strengthening. If the Mn content is less than 0.1%, then this effect is not achievable, whereas if the Mn content exceeds 3%, then the effect becomes saturated. Accordingly, the Mn content is restricted to an amount of not less than 0.1% and not more than 3%. Further, in those cases where elements other than Mn are not added in sufficient amounts to inhibit the occurrence of hot tearing caused by S, it is preferable that the added amount of Mn is sufficient to ensure that the ratio between the Mn content ([Mn]) and the S content ([S]), in mass % values, satisfies $[Mn]/[S] \geqq 20$. Moreover, Mn is also an element which, as the Mn content increases, extends the austenite region temperature towards the low temperature side; thereby, the hardenability is improved and the formation of a continuous-cooling transformation structure having excellent burring properties is facilitated. If the Mn content is less than 0.5%, then it is difficult to realize this effect, and therefore the Mn content is preferably within a range of at least 0.5%, and is more preferably within a range of not less than 0.56% and not more than 2.43%.

A preferred component range in the case of a steel sheet having a tensile strength of at least 540 MPa satisfies Mn: 0.1 to 2%, and a preferred component range in the case of a steel sheet having a tensile strength of at least 780 MPa satisfies Mn: 0.8 to 2.6%.

Accordingly, preferred component ranges in the case of a steel sheet having a tensile strength of at least 540 MPa include:

C: 0.01 to 0.07%,

Si: ≦0.1%,

Mn: 0.1 to 2%, and $$3\times[Si]\geqq[C]-(12/48[Ti]+12/93[Nb]).$$

Preferred component ranges in the case of a steel sheet having a tensile strength of at least 780 MPa include:

C: 0.03 to 0.1%,

Si: 0.01≦Si≦0.1%, and

Mn: 0.8 to 2.6%.

(4) P: not more than 0.1%

P is an unavoidable impurity that is incorporated during refining of the steel, and is an element that is segregated at the grain boundaries, and decreases the toughness as the P content increases. Accordingly, the P content is preferably as low as possible, and if the P content exceeds 0.1%, then P has adverse effects on the formability and the welding properties, and therefore, the P content is restricted to an amount of not more than 0.1%. In consideration of the hole expandability and the welding properties, the P content is preferably within a range of not more than 0.02%, and is more preferably within a range of not less than 0.008% and not more than 0.012%.

(5) S: not more than 0.03%

S is an unavoidable impurity that is incorporated during refining of the steel, and is an element which, if S is incorporated at too large amount, not only S causes cracking during hot rolling, but also S causes the generation of A-type inclusions that cause a deterioration in the hole expandability. For these reasons, the S content should be reduced as much as possible; however, an amount of 0.03% or less is permissible, and therefore the S content is specified as not more than 0.03%. However, in those cases where a certain degree of hole expandability is required, the S content is preferably within a range of not more than 0.01%, is more preferably within a range of not less than 0.002% and not more than 0.008%, and is most preferably within a range of not more than 0.003%.

(6) Al: 0.001 to 1%

Al must be added in an amount of at least 0.001% for the purpose of molten steel deoxidation during the steelmaking process for the steel sheet; however, because the addition of Al increases the cost of the steel, the upper limit for the Al content is set to 1%. Further, if Al is added at too large amount, then it tends to cause an increase in non-metallic inclusions; thereby, the ductility and the toughness are deteriorated, and therefore the Al content is preferably within a range of not more than 0.06%, and is more preferably within a range of not less than 0.016% and not more than 0.04%.

(7) N: not more than 0.01%

N is an unavoidable impurity that is incorporated during refining of the steel, and is an element that bonds with Ti, Nb and the like to form nitrides. If the N content exceeds 0.01%, then because these nitrides precipitate at comparatively high temperatures, they tend to coarsen readily, and there is a possibility that these coarsened crystal grains may act as origins of burring cracking. Furthermore, the content of these nitrides is preferably as low as possible in order to utilize Nb and Ti effectively as described below. Accordingly, the upper limit for the N content is specified as 0.01%. In those cases where the present invention is applied to a member of which the aging deterioration becomes problematic, if the N content exceeds 0.006%, then the aging deterioration tends to be intensified, and therefore the N content is preferably within a range of not more than 0.006%. Moreover, in those cases where the present invention is applied to a member that is presumed to be left at room temperature for at least two weeks after production and before being supplied to the forming process, in terms of countering aging deterioration, the added amount of N is preferably within a range of not more than 0.005%, and is more preferably within a range of not less than 0.0028% and not more than 0.0041%. Furthermore, if consideration is given to the case of being left in a high-temperature environment during the summer season, or the case of being used in an environment which includes exporting via ship or the like to a location that involves crossing the equator, then the N content is preferably within a range of less than 0.003%.

(8) Nb: 0.005 to 0.08%

Nb is one of the most important elements in the present invention. Nb precipitates finely as carbides either during the cooling conducted after the completion of rolling or after coiling, and increases the steel strength by precipitation strengthening. Moreover, Nb fixes C as carbides, and therefore inhibits the generation of cementite which is harmful in terms of the burring properties. In order to obtain these effects, the added amount of Nb must be at least 0.005%, and is preferably within a range of more than 0.01%. On the other hand, even if the Nb content exceeds 0.08%, these effects become saturated. Accordingly, the Nb content is restricted to an amount of not less than 0.005% and not more than 0.08%. The Nb content is preferably within a range of not less than 0.015% and not more than 0.047%.

A preferred Nb range in the case of a steel sheet having a tensile strength of at least 540 MPa but less than 780 MPa is within a range of 0.005 to 0.05%, and by setting the Nb content within this range, the TS and the burring properties can be achieved in a more stable manner.

Further, a preferred Nb range in the case of a steel sheet having a tensile strength of at least 780 MPa is within a range of 0.01 to 0.08%, and by setting the Nb content within this range, the TS and the burring properties can be achieved in a more stable manner.

(9) Ti: 0.001 to 0.2%

Ti is one of the most important elements in the present invention. In a similar manner to Nb, Ti precipitates finely as carbides either during the cold rolling conducted after the completion of rolling or after coiling, and increases the steel strength by precipitation strengthening. Moreover, Ti fixes C as carbides, and therefore inhibits the generation of cementite which is harmful in terms of the burring properties. In order to obtain these effects, the added amount of Ti must be at least 0.001%, and is preferably within a range of not less than 0.005%. On the other hand, even if the Ti content exceeds 0.2%, these effects become saturated. Accordingly, the Ti content is restricted to an amount of not less than 0.001% and not more than 0.2%. The Ti content is preferably within a range of not less than 0.036% and not more than 0.156%.

A preferred Ti range in the case of a steel sheet having a tensile strength of at least 540 MPa but less than 780 MPa is within a range of 0.001 to 0.06%, and by setting the Ti content within this range, the TS and the burring properties can be achieved in a more stable manner.

Further, a preferred Ti range in the case of a steel sheet having a tensile strength of at least 780 MPa is within a range of 0.04 to 0.2%, and by setting the Ti content within this range, the TS and the burring properties can be achieved in a more stable manner.

$$(10)[Nb]\times[C]\leqq 4.34\times10^{-3} \quad (B)$$

Furthermore, in order to achieve satisfactory precipitation strengthening due to Nb, it is necessary to ensure that an adequate amount of Nb exists in a solid solution state within the slab during the slab heating step conducted during the manufacturing process for the hot rolled steel sheet. For this reason, during the slab heating step, the slab must be heating to at least the minimum slab reheating temperature (=SRT-min) calculated using the aforementioned numerical formula (A). However, if the solution temperature exceeds 1,170° C. that represents the eutectic point for fayalite $Fe_2SiO_2$ and wustite FeO, then the surface properties deteriorate. The SRT-min value calculated using numerical formula (A) exceeds 1,170° C. when the product of the Nb content ([Nb]) and the C content ([C]) exceeds $4.34\times10^{-3}$, and therefore the product of the Nb content ([Nb]) and the C content ([C]) must satisfy the above numerical formula (B). The product of the Nb content ([Nb]) and the C content ([C]) is preferably within in a range of not less than 0.00053 and not more than 0.0024.

TiNb(CN) is an MC precipitate having an NaCl structure, and in the case of NbC, although Nb is coordinated at the M site and C is coordinated at the C site, variations in the temperature can cause substitution of Nb with Ti, and substitution of C with N. This also applies for TiN. Even at a temperature where NbC melts completely, Nb is still incorporated within TiN at a site fraction of 10 to 30%, and therefore strictly speaking, Nb is completely solid-solubilized at a temperature of not less than the temperature where TiN melts completely. However, in a component system where the added amount of Ti is comparatively small, this solution temperature may be set to the substantive lower limit temperature at which Nb precipitates melt. Furthermore, the above explanation also applies to TiC, so that although Ti is coordinated at the M site, a proportion of Ti is substituted with Nb at lower temperatures. Accordingly, the solution temperature of the complex precipitate of TiNbCN may be set to the substantive solution temperature of TiC.

In a steel sheet having a tensile strength in the order of 540 MPa (namely, at least 540 MPa but less than 780 MPa), in order to ensure that Si inhibits precipitation of iron-based carbides such as cementite and contributes to an improvement in the ductility as described above, the amount of Si must satisfy the relationship represented by the aforementioned formula relative to the stoichiometric composition of C which is not fixed in the form of precipitates of Ti, Nb and the like, and this enables suppression of cementite precipitation and suppresses any decrease in ductility. Moreover, C that is inhibited from being precipitated as cementite within the crystal grains remains in a supersaturated state inside the grains. However, since lattice disorder exists, C diffuses towards the grain boundaries where C can exist more stably at lower temperatures, and therefore, the amount of C at the grain boundaries can be controlled at the atom density specified by the present invention. This effect manifests, in particular, in the case of a continuous transformation structure in which C is not discharged at the grain boundaries, but undergoes transformation within the grains while still including solid solution C.

On the other hand, in a steel sheet having a tensile strength in the order of 780 MPa (namely, at least 780 MPa), the added amounts of Ti, Nb and the like must be increased in order to achieve the required level of strength. Accordingly, if the following formula is less than 0.005%, then precipitation as cementite does not occur within the grains. However, if the value is not at least 0.0005%, then the density of solid solution C at the grain boundaries also falls outside the range specified in the present invention, and therefore the following range is specified.

In other words, by regulating the components in the manner described below, the density at the grain boundaries can be controlled within the range from 1 to 4.5 atoms/nm$^2$.

In a steel having a tensile strength in the order of 540 MPa and containing 0.001 to 0.06% of Ti and 0.005 to 0.05% of Nb, the following formula is satisfied.

$$0.0005\leqq[C]-(12/48+12/93[Nb])\leqq0.040$$

In a steel having a tensile strength in the order of 780 MPa and containing 0.04 to 0.2% of Ti and 0.01 to 0.08% of Nb, the following formula is satisfied.

$$0.0005\leqq[C]-(12/48[Ti]+12/93[Nb])\leqq0.0050$$

The above description outlines the reasons for restricting the basic components in the present invention; however, in the present invention, one or more of Cu, Ni, Mo, V, Cr, Ca, REM (rare earth metal elements) and B may also be included as required. Reasons for restricting each of these elements are described below.

Cu, Ni, Mo, V and Cr are elements that have the effect of improving the strength of the hot rolled steel sheet by either precipitation strengthening or solid solution strengthening, and one or more of these elements may be added.

However, these effects cannot be satisfactorily achieved if the Cu content is less than 0.2%, the Ni content is less than 0.1%, the Mo content is less than 0.05%, the V content is less than 0.02%, or the Cr content is less than 0.01%. Further, these effects become saturated and the economic viability diminishes if the Cu content exceeds 1.2%, the Ni content exceeds 0.6%, the Mo content exceeds 1%, the V content exceeds 0.2%, or the Cr content exceeds 1%. Accordingly, in those cases where Cu, Ni, Mo, V or Cr is added according to need, the Cu content is preferably within a range of not less than 0.2% and not more than 1.2%, the Ni content is preferably within a range of not less than 0.1% and not more than 0.6%, the Mo content is preferably within a range of not less than 0.05% and not more than 1%, the V content is preferably within a range of not less than 0.02% and not more than 0.2%, and the Cr content is preferably within a range of not less than 0.01% and not more than 1%.

Ca and REM (rare earth metal elements) control the configuration of non-metallic inclusions that can act as fracture origins and tend to cause a deterioration in formability, and are thus elements that improve the formability. If the contained amounts of Ca and REM are less than 0.0005%, then the above effect does not manifest satisfactorily. Further, if the Ca content exceeds 0.005% or the REM content exceeds 0.02%, then the above effect becomes saturated, and the economic viability of the steel tends to decrease. Accordingly, the Ca content is preferably within a range of not less than 0.0005% and not more than 0.005%, whereas the REM content is preferably within a range of not less than 0.0005% and not more than 0.02%.

In those cases where B is segregated at the grain boundaries and exists together with solid solution C, it has the effect of enhancing the grain boundary strength. Accordingly, B may be added as required.

However, if the B content is less than 0.0002%, then the amount of B is insufficient to achieve the above effect, whereas if the B content exceeds 0.002%, then it tends to cause slab cracking. Accordingly, the B content is preferably within a range of not less than 0.0002% and not more than 0.002%.

Furthermore, as the added amount of B is increased, B improves the hardenability and facilitates the formation of a continuous-cooling transformation structure that represents a preferred microstructure in terms of the burring properties, and therefore the added amount of B is preferably within a range of at least 0.0005%, and is more preferably within a range of not less than 0.001% and not more than 0.002%.

However, if only solid solution B exists at the grain boundaries and no solid solution C is present, then the crystal grain strengthening effect is not as large as that provided by solid solution C; thereby, "peeling" becomes more likely.

Furthermore, in the case where no B is added, if the coiling temperature is not less than 650° C., then some of B that acts as a grain boundary segregated element can be substituted with solid solution C to contribute to an improvement in the grain boundary strength, but if the coiling temperature exceeds 650° C., then it is surmised that the grain boundary density of solid solution C and solid solution B falls to less than 1 atom/nm$^2$; thereby, fracture surface cracking occurs.

A hot rolled steel sheet containing the above elements as main components may also include one or more of Zr, Sn, Co, Zn, W and Mg at a total amount of not more than 1%. However, Sn increases the possibility of flaws occurring during hot rolling, and therefore the Sn content is preferably within a range of not more than 0.05%.

Next is a detailed description of metallurgical factors such as the microstructures within the hot rolled steel sheet according to the present invention.

Because it is necessary to increase the grain boundary strength to inhibit fracture surface cracking that occurs during punching or shearing processing, the amounts of solid solution C and solid solution B at or in the vicinity of the grain boundaries, which contribute to an improvement in the grain boundary strength, must be restricted in the manner described above. If the grain boundary density of solid solution C and solid solution B is less than 1 atom/nm$^2$, then the above effect does not manifest satisfactorily. Whereas, if the grain boundary density exceeds 4.5 atoms/nm$^2$, then cementite having a crystal grain size of 1 μm or greater tends to be precipitated. Accordingly, the grain boundary density of the solid solution C (and solid solution B) is set to not less than 1 atom/nm$^2$ and not more than 4.5 atoms/nm$^2$. In the present invention, the grain boundary density of solid solution C and solid solution B refers to the sum of the grain boundary densities of the solid solution C and the solid solution B.

If this value of not less than 1 atom/nm$^2$ and not more than 4.5 atoms/nm$^2$ is converted to ppm, then it is equivalent to a range from approximately 0.02 ppm to 4.3 ppm.

The stretch flange formability and the burring formability that are typically represented by the hole expansion value are affected by voids that act as the origins for cracking generated during punching or shearing processing. These voids are generated in those cases where the cementite phase precipitated at the main phase grain boundaries is reasonably large compared with the main phase grains, thus the main phase grains are subjected to excessive stress in the vicinity of the main phase grain boundaries. However, in those cases where the grain size of the cementite is not more than 1 μm, the cementite grains are relatively small compared with the main phase grains, and therefore, no mechanical stress concentration occurs, and voids are unlikely to develop. As a result, the hole expansion value is improved. Accordingly, the particle size of the grain boundary cementite is restricted to not more than 1 μm.

Although there are no particular restrictions on the microstructure of the main phase of a hot rolled steel sheet according to the present invention, in order to achieve superior stretch flange formability and superior burring formability, a continuous-cooling transformation structure (Zw) is preferred. Furthermore, in order to achieve a combination of the above formability properties and favorable ductility as represented by the uniform elongation, the microstructure of the main phase of a hot rolled steel sheet according to the present invention may include polygonal ferrite (PF) at a volume fraction of not more than 20%. A volume fraction in the microstructure refers to the surface area fraction within a measurement field of view.

The continuous-cooling transformation structure transforms while the solid solution C within the crystal grains are retained within the grain interior. Accordingly, the probability of solid solution C existing at the grain boundaries is low.

However in the present invention, in order to prevent "peeling", the grain boundary density must be controlled to achieve a value within a range from 1 to 4.5 atoms/nm$^2$.

On the other hand, the composition of a steel sheet having a tensile strength in the order of 540 MPa includes comparatively lower amounts of C, Mn, Si, Ti and Nb than the composition of a steel sheet having a tensile strength in the order of 780 MPa, and therefore polygonal ferrite forms more readily. Accordingly, in order to suppress generation of this polygonal ferrite and achieve a continuous-cooling transformation structure, the cooling rate must be set to a comparatively large value. This increase in the cooling rate results in an increase in the amount of solid solution C retained within the grains.

Accordingly, in a steel having a tensile strength of at least 540 MPa but less than 650 MPa, if the composition is regulated such that $0.0005 \leqq [C]-(12/48[Ti]+12/93[Nb]) \leqq 0.0400$, then the atom density at the grain boundaries can be adjusted to a value within the range from 1 to 4.5 atoms/nm$^2$.

Further, in a steel having a tensile strength of at least 650 MPa but less than 780 MPa (650 MPa grade steel) which includes increased amounts of alloy components, because the steel composition means that generation of polygonal ferrite is comparatively unlikely, a continuous-cooling transformation structure can be achieved even if the cooling rate is comparatively low. Therefore, by regulating the composition such that $0.0005 \leqq [C]-(12/48[Ti]+12/93[Nb]) \leqq 0.0100$, the atom density within the range from 1 to 4.5 atoms/nm$^2$ can be achieved with good stability.

Moreover, in a steel having a tensile strength in the order of 780 MPa (namely, 780 MPa or greater) which includes further increased amounts of the alloy components, because the steel composition means that generation of polygonal ferrite is even more unlikely, a continuous-cooling transformation structure can be achieved even if the cooling rate is further lowered. Therefore, by regulating the composition such that $0.0005 \leqq [C]-(12/48[Ti]+12/93[Nb]) \leqq 0.0050$, the atom density within the range from 1 to 4.5 atoms/nm$^2$ can be achieved with good stability.

In the present invention, a continuous-cooling transformation structure (Zw) refers to a microstructure that is defined as a transformation structure at an intermediate stage between a microstructure that contains polygonal ferrite and pearlite generated by a diffusion mechanism, and martensite generated by a shearing mechanism in the absence of diffusion, as disclosed in "Recent Research on the Bainite Structure of Low Carbon Steel and its Transformation Behavior-Final Report of the Bainite Research Committee", edited by the Bainite Investigation and Research Committee of the Basic Research Group of the Iron and Steel Institute of Japan, (1994, The Iron and Steel Institute of Japan). In other words, as described on pages 125 to 127 of the above reference in relation to the microstructure observed by optical microscopy, the continuous-cooling transformation structure (Zw) is defined as a microstructure that mainly includes bainitic ferrite ($\alpha^{\circ}_{B}$), (labeled as $\alpha^{\circ}_{B}$ within the photographs), granular bainitic ferrite ($\alpha_{B}$), and quasi-polygonal ferrite ($\alpha_{q}$), but also contains small amounts of residual austenite ($\gamma_{r}$) and martensite-austenite (MA). In terms of $\alpha_{q}$, in a similar manner to polygonal ferrite (PF), the internal structure does not appear due to etching; however, it has an acicular form, and is therefore clearly distinguishable from PF. Here, if the boundary length of the target crystal grain is assumed to be lq and the equivalent circular diameter is assumed to be dq, grains in which the ratio of these two values (namely, lq/dq) satisfies lq/dq≧3.5 are $\alpha_{q}$ grains. The continuous-cooling transformation structure (Zw) in the present invention can be defined as a microstructure including any one or more of $\alpha^{\circ}_{B}$, $\alpha_{B}$, $\alpha_{q}$, $\gamma_{r}$ and MA, provided that the combined total of the small amounts of $\gamma_{r}$ and MA is 3% or less.

The continuous-cooling transformation structure (Zw) is difficult to determine by optical microscope observation after etching using a nital reagent. Accordingly, determination is made using EBSP-OIM™.

In an EBSP-OIM™ (Electron Back Scatter Diffraction Pattern-Orientation Image Microscopy) method, an electron beam is irradiated onto a highly tilted sample inside a scanning electron microscope, a kikuchi pattern that is faulted by back scattering is captured by a high-resolution camera, and computer-based image analysis is applied to measure the crystal orientation at the irradiation point in a short period of time. The EBSP method enables the quantitative analysis of microstructures and crystal orientations of bulk sample surfaces. Although the analysis area varies depending on the resolution of the SEM, provided the area is within the range that can be observed by the SEM, analysis is possible down to a minimum resolution of 20 nm. Analysis using the EBSP-OIM™ method requires several hours, and is conducted by mapping the region to be analyzed into an equally spaced grid of several tens of thousands of points. In the case of a polycrystalline material, the crystal orientation distribution and crystal grain sizes within the sample can be seen. In the present invention, for the sake of convenience, those structures that can be distinguished using an image mapped with an orientation difference of 15° for each packet may be defined as continuous-cooling transformation structures (Zw).

Next is a detailed description of the reasons for restricting the process for manufacturing a hot rolled steel sheet according to the present invention.

In the present invention, there are no particular restrictions on the process for manufacturing the steel slab containing the components listed above, which is conducted prior to the hot rolling process. In other words, in one example of a process for manufacturing the steel slab containing the above components, melting is first conducted in a blast furnace, converter furnace, electric furnace or the like, a component adjustment process is then conducted using any of the various secondary refining techniques to achieve the targeted amount of each element, and casting may then be conducted using a typical continuous casting method, casting by an ingot method, or casting by another method such as thin slab casting. Scrap metal may be used as a raw material. In the case of a slab obtained by continuous casting, the high-temperature cast slab may be fed directly to the hot rolling apparatus, or may be cooled to room temperature and then reheated in a furnace before undergoing hot rolling.

Prior to the hot rolling step, the slab obtained from the above manufacturing process is subjected to a slab heating process in which the slab is heated in a heating furnace to a temperature of not less than the minimum slab reheating temperature SRTmin (° C.) calculated on the basis of the numerical formula (A) described above. If the temperature is less than SRTmin, then the Nb and Ti carbonitrides are not satisfactorily melted within the base material. In such cases, neither the strength improvement effect due to precipitation strengthening which is obtained by precipitating Nb and Ti as carbides finely either during the cooling conducted after the completion of rolling or after coiling, nor the inhibiting effect that fixes C as carbides and suppresses the generation of cementite which is harmful in terms of the burring properties, can be obtained. Accordingly, the heating temperature during the slab heating step is set to a temperature of not less than the minimum slab reheating temperature (=SRTmin) calculated using the above formula.

Further, if the heating temperature during the slab heating step exceeds 1,170° C., then the temperature exceeds the eutectic point of fayalite $Fe_2SiO_2$ and wustite FeO; thereby, liquid phase oxides are formed, Si scale is generated, and the surface properties are deteriorated. Therefore, the heating temperature is set to not more than 1,170° C. Accordingly, the heating temperature in the slab heating step is restricted to not less than the minimum slab reheating temperature calculated on the basis of the above numerical formula and not more than 1,170° C. At heating temperatures of less than 1,000° C., operating efficiency deteriorates markedly from a scheduling perspective, and therefore the heating temperature is preferably 1,000° C. or greater.

Further, although there are no particular restrictions on the heating time in the slab heating step, in order to ensure that melting of the Nb carbonitrides proceeds satisfactorily, the temperature is preferably held for at least 30 minutes once the aforementioned heating temperature is reached. However, this restriction does not apply in the case where after casting, the slab is supplied directly to the hot rolling step while the high temperature is maintained.

After the slab heating step, the slab extracted from the heating furnace is subjected to rough rolling without any particular delay; thereby, a rough rolling step is commenced to obtain a sheet bar. This rough rolling step is conducted and completed at a temperature of not less than 1,080° C. and not more than 1,150° C. for the reasons outlined below. Namely, if the rough rolling finishing temperature is less than 1,080° C., then the hot deformation resistance during the rough rolling increases, and the likelihood of impediments to conducting the rough rolling is increased. Whereas, if the temperature exceeds 1,150° C., then the secondary scale generated during the rough rolling grows too fast, and removal of the scale in the subsequent descaling and finish rolling steps becomes problematic.

In the case of the sheet bars obtained after the completion of rough rolling, each of these sheet bars may be joined between the rough rolling step and the finish rolling step, so that endless rolling may then be performed in which the finish rolling step is conducted in a continuous manner. In such a case, the sheet bars may be temporarily wound into a coil, and if necessary stored within a cover having a temperature retention function, and then the sheet bars may be unwound and joined.

Furthermore, during the hot rolling step, it may sometimes be desirable that variations in the temperature of the sheet bar in the rolling direction, in the plate width direction and in the plate thickness direction are suppressed to low levels. In such cases, if required, the sheet bar may be heated by a heating apparatus capable of controlling such temperature fluctuations in the rolling direction, in the plate width direction and in the plate thickness direction of the sheet bar, either at a location between the rough rolling apparatus of the rough rolling step and the finish rolling apparatus of the finish rolling step, or a location between each of the stands employed within the finish rolling step. Examples of the system used for this heating apparatus include all manner of heating systems including gas heating, electrical heating, and induction heating, and any conventional heating system may be employed, provided that it is capable of controlling temperature fluctuations in the rolling direction, in the plate width direction and in the plate thickness direction of the sheet bar.

As the heating apparatus system, an induction heating system is preferred as it provides a favorable temperature control response in an industrial setting. And amongst the various induction heating systems, the installation of a plurality of transverse induction heating devices that are able to be shifted in the plate width direction is particularly desirable, as it enables the temperature distribution in the plate width direction to be arbitrarily controlled in accordance with the plate width. Moreover, as the heating apparatus system, an apparatus including a combination of a transverse induction heating device and a solenoid induction heating device that excels in heating across the entire plate width is the most preferred option.

In those cases where temperature control is conducted using these types of apparatus, the amount of heat applied by the heating apparatus may need to be controlled in some cases. In such cases, because the interior temperature of the sheet bar cannot be measured directly, actual previously measured data such as the temperature of the input slab, the slab residence time in the furnace, the heating furnace atmospheric temperature, the heating furnace extraction temperature, and the table roller transport time are preferably used to estimate the temperature distributions in the rolling direction, in the plate width direction and in the plate thickness direction of the sheet bar when the sheet bar arrives at the heating apparatus, and then the amount of heat applied by the heating apparatus is preferably controlled in accordance with these estimations.

The amount of heat applied by an induction heating apparatus can be controlled, for example, in the manner described below. One feature of an induction heating apparatus (a transverse induction heating apparatus) is that when an alternating current is supplied to the coil, a magnetic field is generated therein. When a conductor is positioned inside this magnetic field, an electromagnetic induction effect causes eddy currents having the opposite orientation to the coil current to occur within the conductor in a circumferential direction orthogonal to the magnetic flux, and the resulting Joule heat causes heating of the conductor. These eddy currents are strongest at the inner surface of the coil, and decrease exponentially in an inwards direction (this phenomenon is called the "skin effect"). Accordingly, it is known that as the frequency reduces, the current penetration depth increases; thereby, a more uniform heating pattern is obtained in the thickness direction. Whereas in contrast, as the frequency increases, the current penetration depth decreases; thereby a heating pattern is obtained that exhibits minimal over-heating and a peak at the surface in the thickness direction. Consequently, by using a transverse induction heating apparatus, heating in the rolling direction and in the plate width direction of the sheet bar can be conducted in a conventional manner. Further, in terms of heating in the plate thickness direction, when altering the frequency of the transverse induction heating apparatus so as to vary the penetration depth, the heating temperature pattern in the plate thickness direction can be controlled; thereby, the temperature distribution through the plate thickness can be made more uniform. In this case, the use of a variable frequency induction heating apparatus is preferable; however, the frequency may also be altered using a capacitor. Furthermore, control of the amount of heat supplied by the induction heating apparatus may also be achieved by positioning a plurality of inductors having different frequencies, and then adjusting the amount of heat applied by each inductor so as to achieve the desired heating pattern through the thickness direction. Moreover, because altering the air gap to the material being heated causes a fluctuation in the frequency, the amount of heat supplied by the induction heating apparatus may also be controlled by altering the air gap to achieve the desired frequency and therefore the desired heating pattern.

Furthermore, if necessary, the obtained sheet bar may be subjected to descaling using high-pressure water between the rough rolling step and the finish rolling step, in order to remove any defects caused by scale such as red scale. In this case, the impact pressure P (MPa) of the high-pressure water on the surface of the sheet bar and the flow rate L (liters/cm$^2$) of the high-pressure water preferably satisfy the condition shown below.

$$P \times L \geqq 0.0025$$

Here, P is defined as follows (see "Iron and Steel", 1991, vol. 77, No. 9, page 1450).

$$P = 5.64 \times P_0 \times V / H^2$$

wherein $P_0$ (MPa): liquid pressure

V (liters/min): nozzle flow rate

H (cm): distance between the surface of the steel sheet and the nozzle

Furthermore, the flow rate L is defined as follows.

$$L = V / (W \times v)$$

wherein

V (liters/min): nozzle flow rate

W (cm): width across which the sprayed liquid from a single nozzle makes contact with the surface of the steel sheet.

v (cm/min): threading speed

The upper limit for the value of impact pressure P×flow rate L needs not be restricted in order to achieve the effects of the present invention, but because various disadvantages such as increased nozzle abrasion tend to arise when the nozzle flow rate is increased too much, the value of P×L is preferably not more than 0.02.

Furthermore, the maximum height Ry of the roughness on the steel sheet surface after finish rolling is preferably not more than 15 μm (15 μm Ry, 12.5 nun, ln 12.5 mm). This is because, as is described, for example, on page 84 of the Metal Material Fatigue Design Handbook, edited by the Society of Materials Science, Japan, the fatigue strength of hot rolled or acid washed steel sheet is clearly correlated with the maximum height Ry of the steel sheet surface. In order to achieve this level of surface roughness, it is desirable that the high-pressure water sprayed onto the steel sheet surface in the descaling process satisfies the condition of impact pressure P×flow rate L≧0.003. Furthermore, in order to prevent scale from re-forming on the steel sheet after descaling, the subsequent finish rolling is preferably commenced within 5 seconds after completing the descaling.

The finish rolling step is commenced after completion of the rough rolling step. The time between completing of the rough rolling and starting of the finish rolling is preferably not less than 30 seconds and not more than 150 seconds.

If this time is less than 30 seconds, then a finish rolling start temperature of less than 1,080° C. cannot be achieved unless a special cooling device is employed. Thereby, blisters that may act as the origin for fish-scale or spindle-shaped scale defects are generated between surface scales on the base iron of the steel sheet either prior to finish rolling or during the interpass period, and the formation of these scale defects becomes more likely.

If the time exceeds 150 seconds, then Ti and Nb precipitate as coarse TiC and NbC carbides within the austenite in the sheet bar.

As a result of this precipitation of coarse TiC and NbC, the absolute amount of solid solution C tends to be insufficient within a hot coil which represents one possible configuration for the final hot rolled steel product, and therefore, the grain boundary density of solid solution C falls to less than 1 atom/nm$^2$; thereby, the likelihood of "peeling" increases.

Moreover, Ti and Nb are elements that precipitate finely within the ferrite either during subsequent cooling or after coiling, thereby Ti and Nb contribute to the strength of the steel by precipitation strengthening. Consequently, if Ti and Nb are precipitated as carbides at this stage, and the amounts of solid solution Ti and solid solution Nb are reduced, then improvements in the strength of the hot rolled steel sheet cannot be expected.

Accordingly, the time between the completing of the rough rolling and the starting of the finish rolling is set to not less than 30 seconds and not more than 150 seconds, and is preferably not more than 90 seconds.

In the finish rolling step, if the finish rolling start temperature is 1,080° C. or higher, then blisters that may act as the origin for fish-scale or spindle-shaped scale defects are generated between surface scales on the base iron of the steel sheet either prior to finish rolling or during the interpass period, and therefore, the formation of these scale defects becomes more likely. In contrast, if the finish rolling start temperature is less than 1,000° C., then the rolling temperature applied to the sheet bar that is an object to be rolled tends to decrease with each finish rolling pass. In this temperature range, as the solid solution limit for Nb and Ti decreases, the likelihood increases that coarse TiC and NbC precipitate within the austenite during the finish rolling. As a result of this precipitation of coarse TiC and NbC, the absolute amount of solid solution C tends to be insufficient within a hot coil which represents one possible configuration for the final hot rolled steel product, and therefore, the grain boundary density of solid solution C falls to less than 1 atom/nm$^2$; thereby, the likelihood of "peeling" increases.

If the amounts of solid solution Nb and solid solution Ti decrease during the finish rolling step in the manner described above, then for the reasons described above, an increase in the strength of the steel sheet cannot be expected, and the steel sheet becomes prone to "peeling". Accordingly, the finish rolling start temperature is set to within a range of not less than 1,000° C. but less than 1,080° C.

Furthermore, in the finish rolling step, if the reduction ratio at the final pass is less than 3%, then the threading shape tends to deteriorate, and may have an adverse effects on the shape of the wound coil when a hot coil is formed, an the precision of the sheet thickness of the final product. On the other hand, if the reduction ratio at the final pass exceeds 15%, then the excessive distortion is introduced; thereby, the dislocation density within the interior of the hot rolled steel sheet increases more than necessary. After completion of the finish rolling, since regions having high dislocation density have a high distortion energy, the regions are readily transformed into ferrite structures. Ferrite formed by this type of transformation is precipitated while few amount of carbon is solid-solubilized, and therefore the carbon contained within the main phase tends to be readily concentrated at the interfaces between austenite and ferrite. Thereby, the grain boundary density of solid solution C at the grain boundaries increases, and coarse Nb and Ti carbides are also more likely to precipitate at the interfaces.

If the amounts of solid solution Nb and solid solution Ti are reduced during the finish rolling step in this manner, then for the reasons described above, an increase in the strength of the steel sheet cannot be expected, and the steel sheet becomes prone to "peeling".

Accordingly, the reduction ratio at the final pass in the finish rolling step is restricted to a value of not less than 3% and not more than 15%.

Moreover, in those cases where the finish rolling completion temperature is less than the $Ar_3$ transformation point temperature, ferrite is precipitated either prior to the rolling or during the rolling. The precipitated ferrite undergoes rolling and retains its worked structure after rolling, and therefore, a decrease in the ductility and a deterioration in the formability of the steel sheet obtained after rolling occur. In contrast, if the finish rolling completion temperature exceeds 950° C., then γ grains grow and coarsen in the period between the completion of rolling and the start of cooling; thereby, the grain boundary density of solid solution C increases, and the regions in which ferrite can be precipitated in order to achieve favorable ductility are also reduced. As a result, there is a possibility that the ductility deteriorates. Accordingly, the finish rolling completion temperature in the finish rolling step is not less than the $Ar_3$ transformation point temperature and not more than 950° C. Further, for the same reasons, in order to prevent an increase in the grain boundary density of solid solution C at the grain boundaries, the time between the completion of finish rolling and the start of cooling is preferably not more than 10 seconds.

Although there are no particular restrictions on the rolling speed in the present invention, if the rolling speed at the final rolling stand is less than 400 mpm, then the γ grains grow and coarsen; thereby, the grain boundary density of solid solution C increases, and the regions in which ferrite can be precipitated in order to achieve favorable ductility are also reduced. As a result, there is a possibility that the ductility deteriorates. Further, although the effects of the present invention can be achieved without specifying any particular upper limit for the rolling speed, equipment limitations mean that the rolling speed is typically not more than 1,800 mpm. Accordingly, the rolling speed during finish rolling is preferably set as desired within a range from not less than 400 mpm to not more than 1,800 mpm.

After completion of the finish rolling step, a cooling step is conducted in which, for the reasons outlined below, the obtained steel sheet is cooled from the finish rolling completion temperature to a coiling start temperature for the start of a coiling step described below at a cooling rate that exceeds 15° C./sec. Namely, during the cooling conducted between the completion of the finish rolling step and the start of the coiling step, competition occurs between generations of precipitate nucleations of cementite, TiC, NbC and the like. If the cooling rate is not more than 15° C./sec, then the generation of the cementite precipitate nucleation takes precedence, and cementite grains exceeding 1 μm tend to grow at the grain boundaries during the subsequent coiling step; thereby, a deterioration in the hole expandability occurs. Furthermore, there is a risk that this cementite growth may inhibit the fine precipitation of carbides such as TiC and NbC; thereby, a deterioration in the strength occurs. Moreover, even in the case where, as described below, the coiling temperature is not more than 650° C., or even 550° C. or lower, if the cooling rate is 15° C./sec or lower, then cementite growth is promoted, and there is a possibility that the grain boundary density of solid solution C and/or solid solution B may fall to less than 1 atom/nm$^2$; thereby, fracture surface cracking may occur. As a result, the lower limit for the cooling rate is specified as being higher than 15° C./sec. Although the effects of the present invention can be achieved without specifying any particular upper limit for the cooling rate during the cooling step, if consideration is given to sheet warping caused by thermal distortion, then a cooling rate of not more than 300° C./sec is preferred.

Furthermore, in the cooling step, in order to achieve superior stretch flange formability and superior burring formability, it is preferable that the microstructure includes a continuous-cooling transformation structure (Zw), and a cooling rate that exceeds 15° C./sec is adequate for obtaining this type of microstructure.

In other words, a cooling rate that exceeds 15° C./s but is not more than approximately 50° C./s represents the range for which stable manufacturing can be achieved, and as is evident in the examples, a cooling rate of not more than 20° C./s enables even more stable manufacture.

Furthermore, in a steel sheet having a tensile strength in the order of 540 MPa, in order to obtain a continuous-cooling transformation structure, the cooling rate must be increased slightly. For a 540 MPa steel sheet, the lower limit for the cooling rate is more preferably 30° C./s.

In those cases where the microstructure is fanned to include a continuous-cooling transformation structure (Zw), in order to achieve an improvement in the ductility without causing any significant deterioration in the burring properties, polygonal ferrite may be incorporated within the microstructure at a volume fraction of not more than 20% if required. In such a case, during the cooling step conducted between the completion of the finish rolling step and the start of the coiling step, the steel sheet may be held for 1 to 20 seconds within a temperature region from the $Ar_3$ transformation point temperature to the $Ar_1$ transformation point temperature (namely, two-phase region of ferrite and austenite). This holding time is applied to promote ferrite transformation within the two-phase region, but if the holding time is shorter than 1 second, then the ferrite transformation within the two-phase region is inadequate; thereby, satisfactory ductility cannot be achieved. In contrast, if the holding time exceeds 20 seconds, then the size of the precipitates including Ti and/or Nb tend to coarsen; thereby, there is a risk that the contribution that precipitation strengthening makes to the strength of the steel may deteriorate significantly. For these reasons, the holding time that is preferably set as desired within a range from not less than 1 second to not more than 20 seconds for the purpose of ensuring that polygonal ferrite is incorporated within the continuous-cooling transformation structure during the cooling step. Furthermore, the temperature range at which this holding time of 1 to 20 seconds is performed is preferably not less than the $Ar_1$ transformation point temperature and not more than 860° C. in order to more readily promote ferrite transformation. Moreover, in order to limit the adverse effect on productivity, the holding time is more preferably within a range from 1 to 10 seconds. Furthermore, in order to satisfy these conditions, it is necessary that the above temperature range is reached rapidly by cooling the steel sheet at a cooling rate of at least 20° C./sec after completion of finish rolling. Although there are no particular restrictions on the upper limit for the cooling rate, the capabilities of the cooling equipment require a cooling rate of not more than 300° C./sec. Moreover, if this cooling rate is too high, then there is an increased likelihood that the cooling end temperature may not be able to be controlled, so that overcooling occurs with the temperature overshooting to a temperature lower than the $Ar_1$ transformation point temperature, and in this case, any ductility improvement effect is lost. Therefore, the cooling rate is preferably restricted to not more than 150° C./sec.

In the case of the steel sheet composition of a steel sheet having a tensile strength in the order of 540 MPa, the lower limit for the cooling rate is preferably 20° C./sec in order to achieve a continuous-cooling transformation structure.

In the case of the steel sheet composition of a steel sheet having a tensile strength in the order of 780 MPa, the lower limit for the cooling rate is preferably greater than 15° C./sec in order to achieve a continuous-cooling transformation structure.

The $Ar_3$ transformation point temperature can be easily represented by a relationship with the steel components by the arithmetic formula shown below. In other words, if the Si content (%) is represented by [Si], the Cr content (%) is represented by [Cr], the Cu content (%) is represented by [Cu], the Mo content (%) is represented by [Mo], and the Ni content is represented by [Ni], then the $Ar_3$ transformation point temperature is defined by numerical formula (D) below.

$$Ar_3=910-310\times[C]+25\times[Si]-80\times[Mneq] \quad (D)$$

In those cases where no B is added, [Mneq] is represented by numerical formula (E) shown below.

$$[Mneq]=[Mn]+[Cr]+[Cu]+[Mo]+[Ni]/2+10([Nb]-0.02) \quad (E)$$

In those cases where B is added, [Mneq] is represented by numerical formula (F) shown below.

$$[Mneq]=[Mn]+[Cr]+[Cu]+[Mo]+[Ni]/2+10([Nb]-0.02)+1 \quad (F)$$

Furthermore, the $Ar_1$ transformation point describes the temperature, during cooling, when the austenite phase is eliminated and the transformation $\gamma\rightarrow\alpha$ is complete, but because $Ar_1$ has no simple arithmetic formula such as that shown above for $Ar_3$, a value that is measured using heat cycle testing or the like is typically employed.

In the coiling step, if the coiling temperature is less than 450° C., then the grain size of the cementite precipitated at the grain boundaries tend to coarsen and exceed 1 μm; thereby, a deterioration in the hole expandability occurs. In contrast, if the coiling temperature exceeds 650° C., then the grain boundary density of solid solution C and/or solid solution B falls to less than 1 atom/nm$^2$; thereby, fracture surface cracking occurs. Accordingly, the coiling temperature during the coiling step is restricted to not less than 450° C. and not more than 650° C. In those cases where B is not added, if the coiling temperature exceeds 550° C., then the grain boundary segregation density of solid solution C tends to fall to less than 1 atom/nm$^2$; thereby, fracture surface cracking occurs. Accordingly, in those cases where no B is added, the coiling temperature during the coiling step is restricted to not less than 450° C. and not more than 550° C.

In the present invention, the grain boundary density of solid solution C must be precisely controlled.

Accordingly, the factors listed below are regulated to enable the final grain boundary density of solid solution C to be altered as required.

1) Slab components
2) Heating temperature
3) Time elapsed from rough rolling to finish rolling 4) Finish rolling start temperature
5) Finish rolling final reduction ratio
6) Holding time prior to start of cooling
7) Cooling rate
8) Coiling temperature In order to correct the steel sheet shape and to improve the ductility by introducing mobile dislocations, skinpass rolling is preferably conducted with a reduction ratio of not less than 0.1% and not more than 2% after completion of all of the manufacturing steps. Further, if required, acid washing may also be performed after completion of all the manufacturing steps in order to remove scale adhered to the surface of the obtained hot rolled steel sheet. Moreover, after completion of the acid washing, the resulting hot rolled steel sheet may be subjected to either skinpass rolling at a reduction ratio of not more than 10% or cold rolling at a reduction ratio of up to approximately 40%, which may be conducted either inline or offline.

Moreover, the hot rolled steel sheet according to the present invention may be subjected to heat treatment in a hot-dip plating line, either after casting, after hot rolling or after cooling, and the hot rolled steel sheet may also be subjected to a separate surface treatment. By performing plating in a hot-dip plating line, the corrosion resistance of the hot rolled steel sheet can be improved.

In those cases where the hot rolled steel sheet is subjected to galvanizing after acid washing, the steel sheet may be dipped in the galvanizing bath and then subjected to alloying treatment if required. Performing an alloying treatment not only improves the corrosion resistance of the hot rolled steel sheet, but also improves the welding resistance for all manner of welding techniques including spot welding.

Examples

The present invention is described in further detail below based on a series of examples.

Steel slabs a to m containing the chemical components shown in Table 3 were each melted in a converter furnace, and after continuous casting, they were either fed directly to rough rolling or were reheated and then subjected to rough rolling. Then they were subjected to finish rolling to reduce the sheet thickness to 2.0 to 3.6 mm. After cooling on a runout table, each steel sheet was coiled to complete preparation of a hot rolled steel sheet. More specifically, the hot rolled steel sheets were prepared in accordance with the manufacturing conditions shown in Tables 4 to 7. The chemical compositions shown in the tables are all recorded as mass % values. Further, the remainder of the steel excluding the components shown in Table 3 is composed of Fe and unavoidable impurities. Moreover, the underlined values in Table 3 and Tables 4 to 7 represent values outside of the ranges specified by the present invention.

TABLE 3

| | | Chemical composition (units: mass %) | | | | | | | | | | | | |
|---|---|---|---|---|---|---|---|---|---|---|---|---|---|---|
| | Steel | C | Si | Mn | P | S | Al | N | Nb | Ti | Other (mass %) | [Nb] × [C] | 1* | 2* |
| Inventive example | a | 0.043 | 0.064 | 1.21 | 0.012 | 0.004 | 0.037 | 0.0038 | 0.046 | 0.036 | | 0.00198 | 0.0281 | 0.164 |
| Inventive example | b | 0.041 | 0.071 | 1.14 | 0.009 | 0.003 | 0.040 | 0.0035 | 0.043 | 0.036 | B: 0.0008 | 0.00176 | 0.0265 | 0.187 |
| Inventive example | c | 0.038 | 0.040 | 0.94 | 0.010 | 0.002 | 0.029 | 0.0041 | 0.031 | 0.124 | B: 0.0022, Ca: 0.0015 | 0.00118 | 0.0030 | 0.117 |
| Inventive example | d | 0.035 | 0.033 | 0.56 | 0.011 | 0.002 | 0.022 | 0.0028 | 0.015 | 0.138 | Cu: 0.9, Ni: 0.5 | 0.00053 | −0.0014 | 0.100 |
| Inventive example | e | 0.040 | 0.089 | 1.18 | 0.009 | 0.004 | 0.037 | 0.0030 | 0.036 | 0.041 | V: 0.15 | 0.00144 | 0.0251 | 0.242 |
| Inventive example | f | 0.039 | 0.055 | 1.16 | 0.008 | 0.003 | 0.033 | 0.0035 | 0.037 | 0.042 | Cr: 0.11 | 0.00144 | 0.0237 | 0.141 |
| Inventive example | g | 0.042 | 0.060 | 1.10 | 0.010 | 0.003 | 0.029 | 0.0033 | 0.034 | 0.039 | Mo: 0.06, REM: 0.0008 | 0.00143 | 0.0279 | 0.152 |
| Comparative example | h | 0.082 | 0.006 | 1.55 | 0.009 | 0.004 | 0.016 | 0.0031 | 0.043 | — | | 0.00353 | 0.0820 | −0.064 |
| Comparative example | i | 0.080 | 0.290 | 1.50 | 0.010 | 0.008 | 0.033 | 0.0040 | 0.046 | — | | 0.00368 | 0.0741 | 0.796 |
| Comparative example | j | 0.181 | 0.031 | 1.38 | 0.014 | 0.007 | 0.033 | 0.0042 | 0.001 | — | | 0.00018 | 0.1809 | −0.088 |
| Comparative example | k | 0.002 | 0.022 | 0.11 | 0.008 | 0.002 | 0.048 | 0.0030 | 0.021 | 0.034 | B: 0.0005 | 0.00004 | −0.0092 | 0.075 |
| Comparative example | l | 0.071 | 0.210 | 1.63 | 0.007 | 0.002 | 0.030 | 0.0039 | 0.064 | 0.013 | Mo: 0.09, Cr: 0.2 | 0.00454 | 0.0595 | 0.571 |
| Comparative example | m | 0.039 | 0.940 | 1.33 | 0.011 | 0.005 | 0.034 | 0.0039 | 0.029 | 0.119 | | 0.00113 | 0.0055 | 2.814 |
| Inventive example | n | 0.041 | 0.078 | 2.43 | 0.009 | 0.008 | 0.033 | 0.0041 | 0.041 | 0.068 | | 0.0017 | 0.0187 | 0.215 |
| Inventive example | o | 0.050 | 0.031 | 2.07 | 0.010 | 0.004 | 0.016 | 0.0035 | 0.047 | 0.156 | | 0.0024 | 0.0049 | 0.088 |

TABLE 4

| | | Metallurgical factors | | | Manufacturing conditions | | | | | | |
|---|---|---|---|---|---|---|---|---|---|---|---|
| | Steel No. | Component | Solution temperature (° C.) | $Ar_3$ transformation point temperature (° C.) | Heating temperature (° C.) | Holding time (min) | Rough rolling finish temperature (° C.) | Rough/finish inter-pass time (sec) | Sheet bar heating | Descaling pressure (L/cm$^2$) | Finish rolling start temperature (° C.) |
| Inventive example | 1 | a | 1071 | 781 | 1150 | 30 | 1110 | 90 | No | 0.0030 | 1060 |
| Inventive example | 2 | a | 1071 | 781 | 1150 | 30 | 1110 | 90 | No | 0.0030 | 1060 |
| Comparative example | 3 | a | 1071 | 781 | 1230 | 30 | 1180 | 120 | No | 0.0030 | 1100 |
| Comparative example | 4 | a | 1071 | 781 | 1050 | 30 | 1010 | 60 | Yes | — | 1040 |
| Comparative example | 5 | a | 1071 | 781 | 1150 | 30 | 1050 | 60 | No | 0.0030 | 980 |
| Inventive example | 6 | a | 1071 | 781 | 1150 | 30 | 1110 | 90 | No | — | 1070 |
| Comparative example | 7 | a | 1071 | 781 | 1150 | 30 | 1110 | 210 | Yes | — | 1030 |
| Comparative example | 8 | a | 1071 | 781 | 1150 | 30 | 1080 | 150 | No | 0.0030 | 990 |
| Comparative example | 9 | a | 1071 | 781 | 1150 | 30 | 1110 | 90 | No | 0.0030 | 1060 |
| Comparative example | 10 | a | 1071 | 781 | 1150 | 30 | 1110 | 60 | Yes | — | 1080 |
| Comparative example | 11 | a | 1071 | 781 | 1150 | 30 | 1080 | 120 | No | 0.0030 | 1000 |
| Comparative example | 12 | a | 1071 | 781 | 1150 | 30 | 1110 | 90 | No | 0.0030 | 1060 |
| Comparative example | 13 | a | 1071 | 781 | 1150 | 30 | 1110 | 90 | No | 0.0030 | 1060 |
| Comparative example | 14 | a | 1071 | 781 | 1150 | 30 | 1110 | 90 | No | 0.0030 | 1060 |
| Inventive example | 15 | b | 1057 | 709 | 1160 | 60 | 1130 | 120 | No | 0.0026 | 1070 |
| Comparative example | 16 | b | 1057 | 709 | 1160 | 60 | 1130 | 120 | No | 0.0026 | 1070 |
| Inventive example | 17 | b | 1057 | 709 | 1160 | 10 | 1120 | 120 | No | 0.0026 | 1060 |
| Inventive example | 18 | b | 1057 | 709 | 1160 | 60 | 1130 | 120 | No | 0.0026 | 1070 |
| Inventive example | 19 | b | 1057 | 709 | 1160 | 60 | 1130 | 120 | No | 0.0026 | 1070 |
| Inventive example | 20 | c | 1012 | 735 | 1160 | 60 | 1130 | 60 | Yes | 0.0030 | 1070 |

TABLE 5

| | | Metallurgical factors | | | Manufacturing conditions | | | | | | |
|---|---|---|---|---|---|---|---|---|---|---|---|
| | Steel No. | Component | Solution temperature (° C.) | $Ar_3$ transformation point temperature (° C.) | Heating temperature (° C.) | Holding time (min) | Rough rolling finish temperature (° C.) | Rough/finish inter-pass time (sec) | Sheet bar heating | Descaling pressure (L/cm$^2$) | Finish rolling start temperature (° C.) |
| Inventive example | 21 | d | 931 | 767 | 1160 | 60 | 1130 | 60 | Yes | 0.0030 | 1070 |
| Inventive example | 22 | e | 1034 | 793 | 1160 | 60 | 1130 | 60 | Yes | 0.0030 | 1070 |
| Inventive example | 23 | f | 1035 | 784 | 1160 | 60 | 1130 | 60 | Yes | 0.0030 | 1070 |
| Inventive example | 24 | g | 1033 | 794 | 1160 | 60 | 1130 | 60 | Yes | 0.0030 | 1070 |
| Comparative example | 25 | h | 1142 | 742 | 1170 | 30 | 1130 | 60 | No | 0.0030 | 1080 |
| Comparative example | 26 | i | 1148 | 752 | 1170 | 30 | 1130 | 60 | No | — | 1070 |
| Comparative example | 27 | j | 838 | 759 | 1170 | 30 | 1130 | 60 | No | — | 1070 |
| Comparative example | 28 | k | 732 | 820 | 1170 | 30 | 1130 | 60 | Yes | — | 1080 |
| Comparative example | 29 | l | 1176 | 708 | 1170 | 30 | 1130 | 120 | No | — | 1000 |
| Comparative example | 30 | m | 1008 | 808 | 1230 | 60 | 1130 | 60 | Yes | — | 1080 |
| Inventive example | 31 | n | 1046 | 722 | 1160 | 60 | 1120 | 75 | No | — | 1050 |
| Inventive example | 32 | o | 1091 | 729 | 1160 | 60 | 1120 | 75 | No | — | 1050 |
| Inventive example | 33 | g | 1033 | 794 | 1160 | 60 | 1120 | 75 | No | — | 1050 |
| Inventive example | 34 | a | 1071 | 781 | 1160 | 60 | 1120 | 75 | No | — | 1050 |
| Comparative example | 35 | a | 1071 | 781 | 1160 | 60 | 1120 | 75 | No | — | 1050 |
| Comparative example | 36 | c | 1012 | 735 | 1160 | 60 | 1120 | 75 | No | — | 1050 |
| Inventive example | 37 | c | 1012 | 735 | 1160 | 60 | 1120 | 75 | No | — | 1050 |

TABLE 6

| | | Manufacturing conditions | | | | | | | | | | |
|---|---|---|---|---|---|---|---|---|---|---|---|---|
| | Steel No. | Finish rolling final pass reduction ratio (%) | Finish rolling completion temperature (° C.) | Time until start of cooling (sec) | Finish rolling exit speed (mpm) | Cooling rate (° C./sec) | Holding temperature (° C.) | Holding time (sec) | Coiling temperature (° C.) | Acid washing | Dipping in plating bath | Alloying treatment |
| Inventive example | 1 | 12.8 | 890 | 1.1 | 750 | 30 | — | — | 500 | Yes | Yes | No |
| Inventive example | 2 | 12.8 | 890 | 1.1 | 750 | 30 | 620 | 4.0 | 510 | No | No | No |
| Comparative example | 3 | 12.8 | 920 | 1.1 | 750 | 30 | — | — | 520 | Yes | No | No |
| Comparative example | 4 | 12.8 | 870 | 1.1 | 750 | 30 | — | — | 500 | Yes | No | No |
| Comparative example | 5 | 12.8 | 830 | 1.1 | 750 | 30 | — | — | 500 | Yes | No | No |
| Inventive example | 6 | 12.8 | 910 | 1.1 | 750 | 30 | — | — | 520 | Yes | No | No |
| Comparative example | 7 | 12.8 | 860 | 1.1 | 750 | 30 | — | — | 500 | Yes | No | No |
| Comparative example | 8 | 12.8 | 840 | 1.1 | 750 | 30 | — | — | 490 | Yes | No | No |
| Comparative example | 9 | 18.2 | 900 | 1.1 | 750 | 30 | — | — | 510 | Yes | No | No |
| Comparative example | 10 | 12.8 | 980 | 0.9 | 950 | 30 | 620 | 4.0 | 550 | Yes | No | No |

TABLE 6-continued

| | Steel No. | Manufacturing conditions: Finish rolling final pass reduction ratio (%) | Finish rolling completion temperature (° C.) | Time until start of cooling (sec) | Finish rolling exit speed (mpm) | Cooling rate (° C./sec) | Holding temperature (° C.) | Holding time (sec) | Coiling temperature (° C.) | Acid washing | Dipping in plating bath | Alloying treatment |
|---|---|---|---|---|---|---|---|---|---|---|---|---|
| Comparative example | 11 | 4.5 | 750 | 1.8 | 450 | 30 | — | — | 470 | Yes | No | No |
| Comparative example | 12 | 12.8 | 880 | 1.4 | 600 | 5 | — | — | 490 | Yes | No | No |
| Comparative example | 13 | 12.8 | 890 | 1.1 | 750 | 20 | — | — | 100 | Yes | No | No |
| Comparative example | 14 | 12.8 | 890 | 1.1 | 750 | 20 | — | — | 650 | Yes | No | No |
| Inventive example | 15 | 7.3 | 880 | 1.2 | 700 | 18 | — | — | 600 | Yes | Yes | Yes |
| Comparative example | 16 | 7.3 | 880 | 1.2 | 700 | 18 | — | — | 700 | Yes | No | No |
| Inventive example | 17 | 7.3 | 870 | 1.2 | 700 | 35 | — | — | 590 | Yes | Yes | Yes |
| Inventive example | 18 | 7.3 | 880 | 2.1 | 380 | 35 | 620 | 4.0 | 600 | Yes | Yes | Yes |
| Inventive example | 19 | 7.3 | 880 | 1.2 | 700 | 35 | 710 | 12.0 | 550 | Yes | Yes | Yes |
| Inventive example | 20 | 12.8 | 930 | 0.9 | 950 | 20 | — | — | 600 | Yes | Yes | No |

TABLE 7

| | Steel No. | Manufacturing conditions: Finish rolling final pass reduction ratio (%) | Finish rolling completion temperature (° C.) | Time until start of cooling (sec) | Finish rolling exit speed (mpm) | Cooling rate (° C./sec) | Holding temperature (° C.) | Holding time (sec) | Coiling temperature (° C.) | Acid washing | Dipping in plating bath | Alloying treatment |
|---|---|---|---|---|---|---|---|---|---|---|---|---|
| Inventive example | 21 | 12.8 | 890 | 1.0 | 800 | 20 | — | — | 500 | Yes | Yes | No |
| Inventive example | 22 | 12.8 | 890 | 1.0 | 800 | 50 | — | — | 550 | Yes | Yes | No |
| Inventive example | 23 | 12.8 | 890 | 1.0 | 800 | 50 | — | — | 550 | Yes | Yes | No |
| Inventive example | 24 | 12.8 | 890 | 1.0 | 800 | 50 | — | — | 550 | Yes | No | No |
| Comparative example | 25 | 12.8 | 870 | 1.0 | 800 | 50 | — | — | 570 | Yes | No | No |
| Comparative example | 26 | 12.8 | 870 | 1.0 | 800 | 50 | — | — | 570 | Yes | No | No |
| Comparative example | 27 | 12.8 | 880 | 0.9 | 950 | 20 | — | — | 550 | Yes | No | No |
| Comparative example | 28 | 12.8 | 930 | 0.7 | 1200 | 20 | — | — | 640 | Yes | No | No |
| Comparative example | 29 | 12.8 | 790 | 1.0 | 800 | 10 | — | — | 570 | No | No | No |
| Comparative example | 30 | 7.3 | 930 | 1.0 | 800 | 20 | 620 | 3.0 | 500 | Yes | No | No |
| Inventive example | 31 | 4.5 | 940 | 1.4 | 600 | 20 | — | — | 520 | No | No | No |
| Inventive example | 32 | 4.5 | 940 | 1.4 | 600 | 20 | — | — | 520 | No | No | No |
| Inventive example | 33 | 4.5 | 910 | 1.4 | 600 | 20 | — | — | 520 | No | No | No |
| Inventive example | 34 | 4.5 | 910 | 1.4 | 600 | 25 | — | — | 520 | No | No | No |
| Comparative example | 35 | 4.5 | 910 | 1.4 | 600 | 15 | — | — | 520 | No | No | No |
| Comparative example | 36 | 4.5 | 940 | 1.4 | 600 | 5 | — | — | 520 | No | No | No |
| Inventive example | 37 | 4.5 | 940 | 1.4 | 600 | 30 | — | — | 520 | No | No | No |

In these tables, the term "component" refers to the steel corresponding with that particular symbol and having the components shown in Table 3, the term "solution temperature" refers to the minimum slab reheating temperature calculated using numerical formula (A), and the term "$Ar_3$ transformation point temperature" refers to the temperature calculated using numerical formula (D). Further, the "heating temperature" represents the heating temperature during the heating step, the "holding time" represents the holding time at a predetermined heating temperature during the heating step, the "rough rolling finishing temperature" represents the temperature when rough rolling is finished in the rough rolling step, the "rough/final interpass time" describes the time between completion of the rough rolling step and the start of the finish rolling step, the "sheet bar heating" describes whether or not a heating apparatus is used between the rough rolling step and the finish rolling step, the "descaling pressure" represents the descaling pressure applied by the comparatively high-pressure descaling apparatus provided between the rough rolling and the finish rolling, and the "finish rolling start temperature" describes the temperature at the start of the finish rolling step. Moreover, the "finish rolling final pass reduction ratio" describes the reduction ratio during the final pass in the finish rolling step, the "finish rolling completion temperature" represents the temperature at the completion of the finish rolling step, the "time until start of cooling" describes the time from the completion of the finish rolling step until the start of cooling in the cooling step, the "finish rolling exit speed" represents the threading speed at the exit from the final finish rolling stand, the "cooling rate" represents the average cooling rate from the start of the cooling step on the runout table through to the coiling step but excluding the holding time, the "holding temperature" describes the start temperature within an air-cooling zone, which is provided partway through the cooling step on the runout table and is a zone in which the steel sheet is not cooled with cooling water, the "holding time" describes the air-cooling time within the holding temperature range, the "coiling temperature" describes the temperature during coiling of the steel sheet with a coiler during the coiling step, "acid washing" refers to whether or not an acid washing treatment of the obtained hot rolled steel sheet is conducted, "plating bath dipping" refers to whether or not the obtained hot rolled steel sheet is dipped in a plating bath, and "alloying treatment" describes whether or not an alloying treatment is conducted after the dipping in the plating bath.

The "dipping in plating bath" listed in Tables 6 and 7 was conducted at a Zn bath temperature of 430 to 460° C. Further, the "alloying treatment" was conducted at an alloying temperature of 500 to 600° C.

The material properties of the thus obtained steel sheets are shown in Tables 8 and 9. The methods used for evaluating the obtained steel sheets were the same as the methods described above. In the tables, the "cementite size" describes the grain size of the cementite precipitated at the grain boundaries, the "grain boundary density" describes the segregation density of solid solution C and/or solid solution B at the grain boundaries, and the "microstructure" refers to the microstructure at a point ¼ t through the steel sheet thickness. Moreover, "PF" represents polygonal ferrite, "P" represents pearlite, "B" represents bainite, and "processed F" represents ferrite having residual processing strain. Furthermore, the "tensile test" results each represents the result of testing a JIS No. 5 test piece in the C direction. In the tables, "YP" represents the yield point, "TS" represents the tensile strength, and "El" represents the elongation. The "hole expandability" results each represents the result obtained from a hole expansion test conducted in accordance with the method disclosed in JFS T 1001-1996. Each result for the "fracture surface cracking" shows whether or not cracking was detected by visual inspection, with a result of OK being recorded in the case of no fracture surface cracking, and a result of NG being recorded if fracture surface cracking was observed. Under the heading "surface shape", the term "existence of scale defects" shows whether or not scale defects such as Si scale, fish-scale defects or spindle-shaped scale were detected by visual observation, with a result of OK being recorded in the case of no scale defects, and a result of NG being recorded if scale defects were observed. The "surface roughness Ry" represents the value obtained by the measuring method disclosed in JIS B 0601-1994. The underlined values in Table 6 represent values outside of the ranges specified by the present invention.

TABLE 8

| | | Microstructure | | | Mechanical properties | | | | | Surface properties | |
|---|---|---|---|---|---|---|---|---|---|---|---|
| | | | Grain boundary | | | | | Hole expand- | Existence | | |
| | | Cementite | segregation | | Tensile test | | | ability | of fracture | Existence | Surface |
| | Steel No. | size (μm) | density (atoms/nm$^2$) | Micro-structure | YP (MPa) | TS (MPa) | EI (%) | λ (%) | surface cracking | of scale defects | roughness Ry |
| Inventive example | 1 | 0.3 | 2.90 | Zw | 516 | 621 | 27 | 145 | OK | OK | 14.3 |
| Inventive example | 2 | 0.6 | 2.80 | Zw + 15% PF | 490 | 616 | 30 | 141 | OK | OK | 13.6 |
| Comparative example | 3 | 0.6 | 2.70 | Zw | 522 | 633 | 26 | 136 | OK | NG | 26.1 |
| Comparative example | 4 | 0.5 | 3.00 | Zw | 431 | 522 | 30 | 151 | OK | OK | 15.3 |
| Comparative example | 5 | 0.8 | 0.89 | Zw | 450 | 538 | 29 | 144 | NG | OK | 11.9 |
| Inventive example | 6 | 0.3 | 2.90 | Zw | 522 | 619 | 26 | 148 | OK | OK | 16.1 |
| Comparative example | 7 | 0.4 | 0.50 | Zw | 444 | 534 | 28 | 133 | NG | OK | 17.8 |
| Comparative example | 8 | 0.7 | 0.80 | Zw | 430 | 528 | 29 | 140 | NG | OK | 11.4 |
| Comparative example | 9 | 0.5 | 0.90 | Zw | 420 | 542 | 29 | 133 | NG | OK | 10.8 |
| Comparative example | 10 | 0.8 | 1.80 | Zw | 552 | 649 | 19 | 118 | OK | OK | 20.3 |
| Comparative example | 11 | 0.9 | 2.80 | Processed F + P | 628 | 684 | 13 | 69 | OK | OK | 14.8 |
| Comparative example | 12 | 1.1 | 0.80 | PF + P | 490 | 579 | 25 | 74 | NG | OK | 13.4 |
| Comparative example | 13 | 3.0 | 4.70 | Zw | 420 | 566 | 31 | 69 | OK | OK | 12.2 |
| Comparative example | 14 | 0.2 | 0.30 | PF + P | 495 | 584 | 28 | 147 | NG | OK | 14.3 |
| Inventive example | 15 | 0.8 | 2.40 | Zw | 538 | 630 | 26 | 139 | OK | OK | 13.8 |
| Comparative example | 16 | 0.4 | 0.60 | PF + P | 500 | 604 | 28 | 142 | NG | OK | 14.1 |
| Inventive example | 17 | 0.8 | 2.20 | Zw | 477 | 569 | 28 | 140 | OK | OK | 14.4 |
| Inventive example | 18 | 0.7 | 2.10 | Zw + 5% PF | 533 | 634 | 28 | 129 | OK | OK | 13.9 |
| Inventive example | 19 | 0.6 | 1.90 | PF + P | 477 | 549 | 29 | 138 | OK | OK | 14.2 |
| Inventive example | 20 | 0.7 | 2.70 | Zw | 680 | 789 | 19 | 94 | OK | OK | 11.8 |

TABLE 9

| | | Microstructure | | | Mechanical properties | | | | | Surface properties | |
|---|---|---|---|---|---|---|---|---|---|---|---|
| | | | Grain boundary | | | | | Hole expand- | Existence | | |
| | | Cementite | segregation | | Tensile test | | | ability | of fracture | Existence | Surface |
| | Steel No. | size (μm) | density (atoms/nm$^2$) | Micro-structure | YP (MPa) | TS (MPa) | EI (%) | λ (%) | surface cracking | of scale defects | roughness Ry |
| Inventive example | 21 | 0.4 | 2.61 | Zw | 651 | 758 | 21 | 108 | OK | OK | 11.0 |
| Inventive example | 22 | 0.3 | 1.20 | Zw | 530 | 623 | 26 | 134 | OK | OK | 13.4 |
| Inventive example | 23 | 0.3 | 1.31 | Zw | 547 | 630 | 26 | 140 | OK | OK | 12.6 |
| Inventive example | 24 | 0.5 | 1.08 | Zw | 560 | 645 | 26 | 141 | OK | OK | 11.7 |
| Comparative example | 25 | 2.9 | 4.50 | PF + P | 561 | 638 | 25 | 54 | OK | OK | 12.6 |
| Comparative example | 26 | 3.6 | 3.80 | PF + P | 520 | 603 | 24 | 48 | OK | NG | 18.0 |

TABLE 9-continued

| | | Microstructure | | | Mechanical properties | | | | | Surface properties | |
|---|---|---|---|---|---|---|---|---|---|---|---|
| | | Cementite | Grain boundary segregation | | Tensile test | | | Hole expand-ability | Existence of fracture | Existence | Surface |
| | Steel No. | size (μm) | density (atoms/nm$^2$) | Micro-structure | YP (MPa) | TS (MPa) | EI (%) | λ (%) | surface cracking | of scale defects | roughness Ry |
| Comparative example | 27 | 6.4 | 4.22 | PF + P | 453 | 544 | 28 | 45 | OK | OK | 15.4 |
| Comparative example | 28 | Not observed | 0.01 | PF | 224 | 298 | 47 | 155 | NG | OK | 16.0 |
| Comparative example | 29 | 4.1 | 4.00 | Zw | 538 | 633 | 25 | 40 | OK | NG | 38.4 |
| Comparative example | 30 | 0.8 | 2.70 | Zw + 20% PF | 722 | 811 | 20 | 91 | OK | NG | 30.1 |
| Inventive example | 31 | 0.6 | 1.68 | Zw | 713 | 808 | 21 | 96 | OK | OK | 12.3 |
| Inventive example | 32 | 0.2 | 2.80 | Zw | 726 | 822 | 19 | 92 | OK | OK | 13.6 |
| Inventive example | 33 | 0.4 | 1.10 | Zw | 558 | 652 | 25 | 138 | OK | OK | 14.2 |
| Inventive example | 34 | 0.4 | 2.40 | Zw | 511 | 618 | 29 | 139 | OK | OK | 10.3 |
| Comparative example | 35 | 0.8 | 0.50 | Zw + 15% PF | 478 | 611 | 30 | 136 | NG | OK | 11.9 |
| Comparative example | 36 | 0.4 | 0.80 | Zw + 20% PF | 662 | 781 | 21 | 90 | NG | OK | 12.9 |
| Inventive example | 37 | 0.3 | 1.20 | Zw | 669 | 799 | 20 | 103 | OK | OK | 13.4 |

The steels that conform to the present invention are the 17 steels labeled No. 1, 2, 6, 15, 17, 18, 19, 20, 21, 22, 23, 24, 31, 32, 33, 34 and 37. Each of these steel sheets represents a high-strength steel sheet with a tensile strength in the order of 540 MPa which contains predetermined amounts of the steel components, has a grain size of the cementite precipitated at the grain boundaries of not more than 1 μm, has a grain boundary density of solid solution C and/or solid solution B of not less than 1 atom/nm$^2$ and not more than 4.5 atoms/nm$^2$, exhibits excellent surface properties with no external appearance degradation due to Si scale or the like, and exhibits excellent fatigue durability at end faces formed by shearing or punching processes.

The steels other than those listed above do not satisfy the requirements of the present invention for the reasons outlined below. Namely, in steel No. 3, the heating temperature is outside the range specified in the process for manufacturing a hot rolled steel sheet according to the present invention; thereby, Si scale develops and the surface properties are poor. In steel No. 4, the heating temperature is outside the range specified in the process for manufacturing a hot rolled steel sheet according to the present invention; thereby, a satisfactory tensile strength cannot be obtained. In steel No. 5, the finish rolling start temperature is outside the range specified in the process for manufacturing a hot rolled steel sheet according to the present invention; thereby, the grain boundary density targeted by the hot rolled steel sheet of the present invention cannot be achieved. As a result, fracture surface cracking occurs. In steel No. 7, the rough/finish interpass time is outside the range specified in the process for manufacturing a hot rolled steel sheet according to the present invention; thereby, the grain boundary density targeted by the hot rolled steel sheet of the present invention cannot be achieved. As a result, fracture surface cracking occurs. In steel No. 8, the finish rolling start temperature is outside the range specified in the process for manufacturing a hot rolled steel sheet according to the present invention; thereby, the grain boundary density targeted by the hot rolled steel sheet of the present invention cannot be achieved. As a result, fracture surface cracking occurs. In steel No. 9, the finish rolling final pass reduction ratio is outside the range specified in the process for manufacturing a hot rolled steel sheet according to the present invention; thereby, the grain boundary density targeted by the hot rolled steel sheet of the present invention cannot be achieved. As a result, fracture surface cracking occurs. In steel No. 10, the finish rolling completion temperature is outside the range specified in the process for manufacturing a hot rolled steel sheet according to the present invention; thereby, the expected ductility cannot be obtained. In steel No. 11, the finish rolling completion temperature is outside the range specified in the process for manufacturing a hot rolled steel sheet according to the present invention; thereby, processed structures are retained, and satisfactory ductility cannot be obtained. In steel No. 12, the cooling rate during the cooling step is outside the range specified in the process for manufacturing a hot rolled steel sheet according to the present invention; thereby, the cementite grain size and grain boundary density values targeted by the hot rolled steel sheet of the present invention cannot be achieved. As a result, fracture surface cracking occurs and an unsatisfactory hole expansion value is obtained. In steel No. 13, the coiling temperature is outside the range specified in the process for manufacturing a hot rolled steel sheet according to the present invention; thereby, the cementite grain size targeted by the hot rolled steel sheet of the present invention cannot be achieved, and the result makes it impossible to achieve a satisfactory hole expansion value. In steel No. 14, the coiling temperature is outside the range specified in the process for manufacturing a hot rolled steel sheet according to the present invention; thereby, the grain boundary density targeted by the hot rolled steel sheet of the present invention cannot be achieved. As a result, fracture surface cracking occurs. In steel No. 16, the coiling temperature is outside the range specified in the process for manufacturing a hot rolled steel sheet according to the present invention; thereby, the grain boundary density targeted by the hot rolled steel sheet of the present invention cannot be achieved. As a result, the occurrence of fracture surface cracking. In steel No. 25, the steel composition is outside of the range specified for the hot rolled steel sheet of the present invention, and the targeted cementite grain size cannot be achieved; thereby, a satisfactory hole expansion value cannot be obtained. In steel No. 26, the steel composition is outside of the range specified for the hot rolled steel sheet of the present invention, and the targeted cementite grain size cannot be achieved; thereby, a satisfactory hole expansion value cannot be obtained. The surface properties are also poor. In steel No. 27, the steel composition is outside of the range specified for the hot rolled steel sheet of the present invention; thereby, the targeted cementite grain size cannot be achieved, and as a result, a satisfactory hole expansion value cannot be obtained. In steel No. 28, the steel composition is outside of the range specified for the hot rolled steel sheet of the present invention; thereby, a satisfactory tensile strength cannot be obtained. In steel No. 29, the steel composition is outside of the range specified for the hot rolled steel sheet of the present invention and the targeted cementite grain size cannot be achieved; thereby, a satisfactory hole expansion value cannot be obtained. The surface properties are also poor. In steel No. 30, the steel composition is outside of the range specified for the hot rolled steel sheet of the present invention. As a result, poor surface properties are obtained. In steel No. 35, the cooling rate is a low value of 15° C./s. As a result, fracture surface cracking (peeling) occurs. In steel No. 36, the cooling rate is an even lower value of 5° C./s, and not only does the hole expanding ratio decrease, but fracture surface cracking (peeling) also occurs.

INDUSTRIAL APPLICABILITY

The steel sheet manufactured in accordance with the present invention can be used not only in motor vehicle components such as inner sheet members, structural members and underbody members that require a high degree of strength and superior hole expandability, but also in all manner of other applications such as ships, buildings, bridges, marine structures, pressurized vessels, line pipes, and machine components.

However, rather than a thick sheet manufacturing process, the hot rolled steel sheet of the present invention is manufactured using a hot rolling process that includes a coiling step, and therefore the upper limit for the sheet thickness is 12 mm

The invention claimed is:

1. A high-strength hot rolled steel sheet free from peeling and excellent in surface properties and burring properties, comprising, in terms of mass %, C: 0.03 to 0.1%,
Si: 0.01 to 0.1%,
Mn: 0.8 to 2.6%,
P: not more than 0.1%,
S: not more than 0.03%,
Al: 0.001 to 1%,
N: not more than 0.01%,
Nb: 0.01 to 0.08%, and
Ti: 0.04 to 0.2%, with a remainder being iron and unavoidable impurities, wherein if said Nb content is represented by [Nb], said C content is represented by [C], and said Ti content is represented by [Ti], then said steel sheet satisfies formulae below:

$$[Nb]\times[C]\leqq 4.34\times 10^{-3},$$

$$0.0005\leqq[C]-(12/48[Ti]+12/93[Nb])\leqq 0.005$$

a grain boundary density of solid solution C is not less than 1 atom/nm$^2$ and not more than 4.5 atoms/nm$^2$, a grain size of cementite precipitated at grain boundaries within said steel sheet is not more than 1 μm, and a tensile strength is at least 780 MPa.

2. The high-strength hot rolled steel sheet free from peeling and excellent in surface properties and burring properties according to claim 1, wherein said steel sheet further comprises, in terms of mass %, one or more elements selected from Cu: 0.2 to 1.2%, Ni: 0.1 to 0.6%, Mo: 0.05 to 1%, V: 0.02 to 0.2%, and Cr: 0.01 to 1%.

3. The high-strength hot rolled steel sheet free from peeling and excellent in surface properties and burring properties according to claim 1, wherein said steel sheet further comprises, in terms of mass %, either or both of Ca: 0.0005 to 0.005% and REM: 0.0005 to 0.02%.

4. The high-strength hot rolled steel sheet free from peeling and excellent in surface properties and burring properties according to claim 1, wherein the steel sheet further comprises, in terms of mass %, B: 0.0002 to 0.002%, and a grain boundary density of either one or both of said solid solution C and solid solution B is not less than 1 atom/nm$^2$ and not more than 4.5 atoms/nm$^2$.

5. The high-strength hot rolled steel sheet free from peeling and excellent in surface properties and burring properties according to claim 1, wherein said steel sheet is galvanized.

6. A method for manufacturing the high-strength hot rolled steel sheet free from peeling and excellent in surface properties and burring properties according to claim 1, the method comprising:

heating a steel slab having elements described in claim 1 at a temperature that is not less than a temperature of SRTmin (° C.) satisfying a formula shown below and not more than 1,170° C., $$SRTmin=6670/\{2.26-\log([Nb]\times[C])\}-273;$$

performing rough rolling at a finishing temperature of not less than 1,080° C. and not more than 1,150° C.;

subsequently starting finish rolling within not less than 30 seconds and not more than 150 seconds at a temperature of not less than 1,000° C. but less than 1,080° C.;

completing said finish rolling within a temperature range from not less than an $Ar_3$ transformation point temperature to not more than 950° C. so as to achieve a final pass reduction ratio of not less than 3% and not more than 15%; and conducting cooling at a cooling rate exceeding 15° C./sec from a cooling start temperature to a temperature within a range from not less than 450° C. to not more than 550° C., then coiling said steel sheet.

7. The method for manufacturing the high-strength hot rolled steel sheet free from peeling and excellent in surface properties and burring properties according to claim 6, wherein the method further comprises: acid washing said steel sheet obtained after coiling; and subsequently dipping said steel sheet in a galvanizing bath in order to galvanize a surface of said steel sheet.

8. The method for manufacturing the high-strength hot rolled steel sheet free from peeling and excellent in surface properties and burring properties according to claim 7, wherein the method further comprises subjecting said steel sheet obtained after galvanizing to an alloying treatment.

* * * * *